US009152073B2

(12) United States Patent
Orikasa et al.

(10) Patent No.: US 9,152,073 B2
(45) Date of Patent: Oct. 6, 2015

(54) CHARGING DEVICE, IMAGE FORMING APPARATUS, AND CHARGING UNIT

(71) Applicants: Takamichi Orikasa, Kanagawa (JP); Fumihito Itoh, Kanagawa (JP); Tomohiko Saito, Kanagawa (JP); Atsushi Satoh, Kanagawa (JP)

(72) Inventors: Takamichi Orikasa, Kanagawa (JP); Fumihito Itoh, Kanagawa (JP); Tomohiko Saito, Kanagawa (JP); Atsushi Satoh, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 5 days.

(21) Appl. No.: 14/024,929

(22) Filed: Sep. 12, 2013

(65) Prior Publication Data

US 2014/0079431 A1 Mar. 20, 2014

(30) Foreign Application Priority Data

Sep. 18, 2012 (JP) ..... 2012-205022
Mar. 15, 2013 (JP) ..... 2013-054390

(51) Int. Cl.
*G03G 15/02* (2006.01)
*G03G 21/20* (2006.01)

(52) U.S. Cl.
CPC ..... *G03G 15/0258* (2013.01); *G03G 21/206* (2013.01)

(58) Field of Classification Search
CPC ..... G03G 15/0258; G03G 21/206
USPC ..... 399/92, 93
See application file for complete search history.

(56) References Cited

U.S. PATENT DOCUMENTS

2006/0024082 A1* 2/2006 Gila et al. ..... 399/93
2006/0045558 A1* 3/2006 Nishida et al. ..... 399/93

FOREIGN PATENT DOCUMENTS

JP 61-015163 1/1986
JP 61-084665 4/1986
JP 02-184874 7/1990
JP 07-134532 5/1995
JP 2010271354 A * 12/2010

OTHER PUBLICATIONS

Machine translation ofg Nogami, JP 2010-271354 (2010).*

* cited by examiner

*Primary Examiner* — David Gray
*Assistant Examiner* — Sevan A Aydin
(74) *Attorney, Agent, or Firm* — Harness, Dickey & Pierce

(57) ABSTRACT

A charging device includes a discharge electrode configured to charge a surface of an image carrier; a charging device body including an opening portion that is provided so as to surround the discharge electrode and be opposed to a surface of the image carrier across a longitudinal direction of the discharge electrode; a charging duct member that is provided so as to surround at least the entire opening portion and configured to introduce and exhaust an airflow within the surrounded area; an intake unit configured to generate an airflow to be guided into the charging duct member; and an exhaust unit configured to exhaust the airflow guided. The charging duct member includes an airflow wall forming unit for covering, with an airflow wall, the entire opening portion from an upstream end to a downstream end in a rotation direction of the image carrier at the opening portion.

16 Claims, 28 Drawing Sheets

CASE WITH FIRST GUIDE PLATE 48

CASE WITHOUT FIRST GUIDE PLATE 48

CHARGING DEVICE, IMAGE FORMING APPARATUS, AND CHARGING UNIT

CROSS-REFERENCE TO RELATED APPLICATIONS

The present application claims priority to and incorporates by reference the entire contents of Japanese Patent Application No. 2012-205022 filed in Japan on Sep. 18, 2012 and Japanese Patent Application No. 2013-054390 filed in Japan on Mar. 15, 2013.

BACKGROUND OF THE INVENTION

1. Field of the Invention

The present invention relates to a charging device, an image forming apparatus, and a charging unit.

2. Description of the Related Art

Known as an electrophotographic image forming apparatus is one which uses a photosensitive drum as an image carrier to charge its surface, exposes the surface to light, and accordingly forms an electrostatic latent image, attaches toner to the electrostatic latent image to make the image visible, and transfers the image onto paper to form an image.

In such an image forming apparatus, a corotron and a scorotron charging device that use a corona discharge is in practical use as a charging device that charges a photosensitive drum. In these devices, a corona discharge member/discharge electrode functions, for example, to generate a corona discharge and charge the surface of the photosensitive drum by ions produced by the discharge by tightly stretching (meaning providing in a stretched state) a discharge wire with a small diameter and applying a high voltage thereto. When a positive or negative high voltage is applied to the discharge wire, fine particles floating in the air, which have been reversely charged, for example, foreign objects such as toner particles and paper powder are attracted and attached to the discharge wire. Hence, there is a problem that if a high voltage is continued to be applied to the discharge wire, the discharge wire becomes dirty due to the accumulation of the attached foreign objects, which leads to that a corona discharge does not occur normally.

In order to deal with the above problem, some image forming apparatuses including a constant-current power supply to apply a voltage to a corona discharge wire, a unit to detect the applied voltage to the corona discharge wire, and a cleaning control unit have also a mechanism for cleaning the corona discharge wire. In such image forming apparatuses, the surface of the wire becomes damaged over time due to the influence of the cleaning, which results in the shortening of the life of the wire.

In order to deal with the above problem, the following technologies are known (for example, see Japanese Laid-open Patent Publication No. 61-015163 and Japanese Laid-open Patent Publication No. 61-084665). In other words, a known electrophotographic image forming apparatus has a feature that an airflow to a charging device generates an air curtain from the flow of an airflow flowing from an upper opening portion of a shield plate to a discharge wire, a flow on an exhaust side is inhibited, and foreign object contamination into the charging device is prevented. Moreover, there is a feature that only a flow velocity in the vicinity of an insulation block supporting the discharge wire is higher than the other places, as a feature of the flow of an airflow.

Moreover, apart from the above, it is configured to prevent foreign object contamination of the discharge wire only with a configuration to flow an airflow from the upper side of a charger (for example, see Japanese Laid-open Patent Publication No. 7-134532). In this technology, the flow of an airflow by a difference in flow velocity and the area and position to which air is flown are not specified.

Therefore, there is a need to provide a charging device having a configuration with an airflow effect where foreign objects are not attracted and attached to a discharge wire by making good use of an airflow to deal with reduction in the life of the discharge wire due to foreign object contamination.

SUMMARY OF THE INVENTION

It is an object of the present invention to at least partially solve the problems in the conventional technology.

According to an embodiment, there is provided a charging device that includes a discharge electrode configured to charge a surface of an image carrier; a charging device body including an opening portion for charging, the opening portion being provided so as to surround the discharge electrode and be opposed to a surface of the image carrier across a longitudinal direction of the discharge electrode; a charging duct member provided so as to surround at least the entire opening portion of the charging device body, the charging duct member being configured to introduce and exhaust an airflow within the surrounded area; an intake unit configured to generate an airflow to be guided into the charging duct member; and an exhaust unit configured to exhaust the airflow guided into the charging duct member. The charging duct member includes an airflow wall forming unit for covering, with an airflow wall, the entire opening portion from an upstream end in a rotation direction of the image carrier at the opening portion to a downstream end in the rotation direction of the image carrier at the opening portion.

According to another embodiment, there is provided an image forming apparatus that includes the charging device according to the above embodiment.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
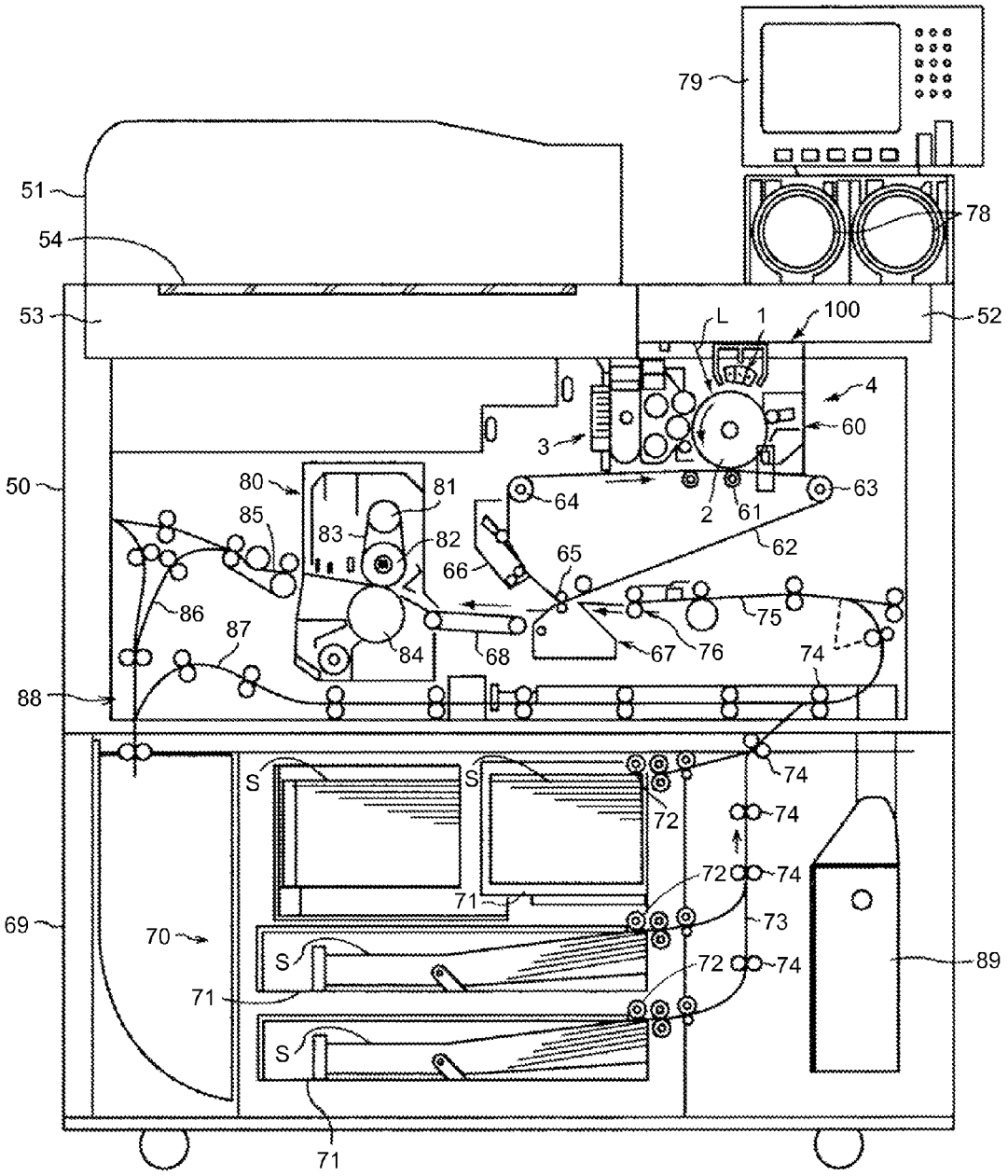
FIG. 1 is a block diagram of an entire image forming apparatus including a charging device illustrating a first embodiment of the present invention.

Hereinafter, embodiments (hereinafter referred to as the "embodiments") of the present invention including examples will be described in detail with reference to the drawings. The same reference numerals are assigned to elements (such as members and components) including the same function, shape, and the like throughout the embodiments and the like once their descriptions are given unless there is concern for confusion, and their descriptions are omitted. For simplification of drawings and descriptions, an element which should be represented in a drawing but is not particularly necessary to be described in the drawing may be omitted without notice as appropriate. When a description is given citing elements of Japanese unexamined patent publications and the like, their reference numerals are shown with round brackets to distinguish them with elements of the embodiments and the like.

First Embodiment

A configuration of an entire image forming apparatus including a charging device of a first embodiment of the present invention will be described with reference to FIG. 1. FIG. 1 is a block diagram of the entire image forming apparatus including the charging device illustrating the first embodiment of the present invention.

Figure 3:
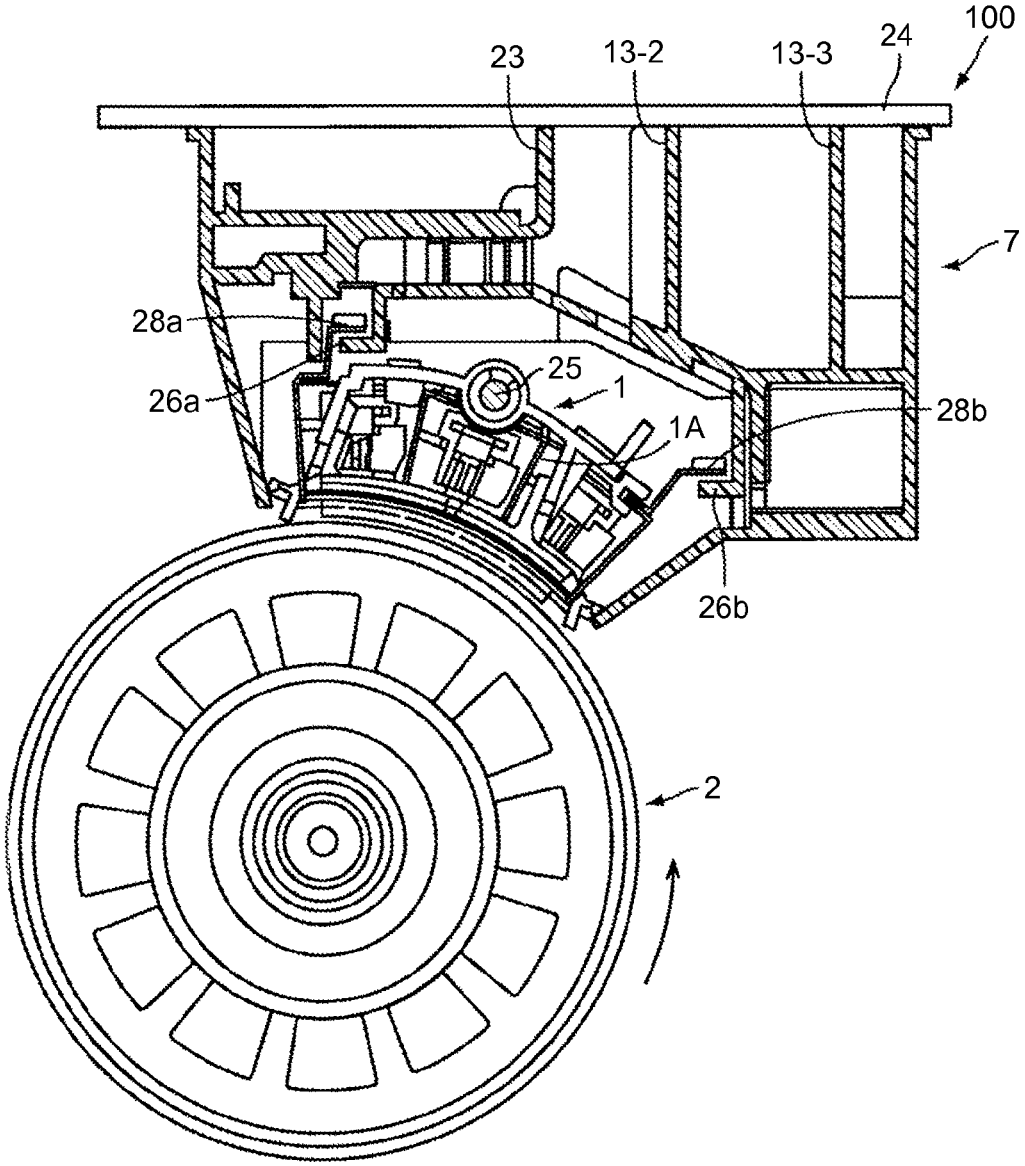
FIG. 3 is a partial cross-sectional front view illustrating layout arrangement in the front side of the charging device with a photosensitive drum as a center.

In FIG. 1, a reference numeral 50 denotes an apparatus body of a laser copying machine (hereinafter referred to as the "image forming apparatus body") as an example of an electrophotographic image forming apparatus such as a printer, a facsimile, a plotter, or a multifunction printer (MFP) having a plurality of these functions, or the like. The image forming apparatus body 50 includes a drum-shaped photosensitive drum 2 as an example of an image carrier. A charging device 100, a developing device 3, a primary transfer roller 61, and a cleaning device 60 are arranged in order around the photosensitive drum 2 in the rotation direction of the photosensitive drum 2 (anticlockwise indicated by an arrow). An image forming unit 4 mainly includes the photosensitive drum 2, the charging device 100, an exposure device to be described below, and the developing device 3. The primary transfer roller 61 is arranged beneath the photosensitive drum 2 across an intermediate transfer belt 62. The charging device 100 includes an electric charger 1, also called a charger, and a charging duct 7 as illustrated in FIG. 3 and the like, which are described below.

A laser writing device 52 as the exposure device is arranged above the above devices. The laser writing device 52 includes unillustrated known components including a light source such as a laser diode, a rotating polygon mirror for scanning, a polygon motor, and a scanning optical system such as a scanning lens including an fθ lens.

A document reading device 53 is arranged in the upper part of the image forming apparatus body 50. The document reading device 53 includes unillustrated known components including a light source, a plurality of mirrors, an image forming lens, and an image sensor such as a CCD.

An intermediate transfer device is arranged in the vicinity beneath the photosensitive drum 2. The intermediate transfer device is provided with the endless intermediate transfer belt 62 wound around three support rollers 63, 64, and 65 in a manner capable of travelling and rotating in an arrow direction (clockwise) in the drawing.

One of the three support rollers 63, 64, and 65 is configured as a drive roller, and the others are configured as driven rollers. The intermediate transfer belt 62 has a function of applying a reverse-bias (+) voltage, and transferring/conveying a toner image attached to a latent image formed on the surface of the photosensitive drum 2. The support roller 65 serves also as a secondary transfer roller. A secondary transfer nip portion is formed by pressing the intermediate transfer belt 62 against a secondary transfer device 67. A secondary transfer bias is applied by the secondary transfer device 67 to the support roller 65 serving also as the secondary transfer roller.

A belt-type conveying device 68 and a fixing device 80 are arranged on the left side of the secondary transfer device 67 in the drawing. The fixing device 80 is provided with a heating roller 81 with a built-in heater, a fixing roller 82, an endless fixing belt 83 wound around the heating roller 81 and the fixing roller 82, and a pressing roller 84 that presses against the fixing roller 82 from below via the fixing belt 83.

A duplex unit 88 is included in the lower part of the image forming apparatus body 50. The duplex unit 88 is provided with a re-feed path 87 communicating with a feed path 75 extended to the secondary transfer device 67. In the duplex unit 88, a reverse path 86 is formed by branching off from the middle of a discharge path 85 extended from an exit of the fixing device 80. The feed path 75 is connected to a bypass feed path extended from a bypass feed tray (not illustrated) in the horizontal direction.

A contact glass 54 is placed on an upper surface of the image forming apparatus body 50. An automatic document feeder (ADF) 51 is openably/closably mounted on the apparatus body 50 so as to cover the contact glass 54.

Tonner bottles 78 are provided on the right side of the automatic document feeder 51. Furthermore, an operation panel 79 for operating the image forming apparatus is provided on the top of the tonner bottles 78. The number of the tonner bottles 78 mounted is two and is automatically supplied to the developing device 3. When the toner in one of the tonner bottles 78 is consumed, the other tonner bottle 78 is to be switched.

The image forming apparatus body 50 is designed to be mounted on a paper feed table 69. In the paper feed table 69, multiple paper feed cassettes 71 (three cassettes in the embodiment) where sheets S such as paper as an example of sheet-shaped recording media are housed and loaded are equipped as a paper feeding unit 70. The paper feed cassettes 71 are provided with their corresponding paper feeding rollers 72. The paper feeding roller 72 is designed to introduce the sheet S sent out to a conveying path 73 connected to the feed path 75. A plurality of pairs of carriage rollers 74 is provided to the conveying path 73.

A waste tonner tank 89 for accumulating and discarding used toner is arranged in the right side of the paper feed table 69 in the drawing.

When a copy is made using a laser copying machine including the above configuration, a document is set on the automatic document feeder 51, or the automatic document feeder 51 is opened to set the document directly on the contact glass 54. An unillustrated start switch is then pressed. The automatic document feeder 51 is driven and accordingly the document conveyed onto the contact glass 54 or the document previously set on the contact glass 54 is read pixel by pixel by the document reading device 53.

The paper feeding roller 72 of the relevant paper feed cassette 71 in the paper feed table 69 is rotated in accordance with a document reading operation, and the sheet S is sent out from the corresponding paper feed cassette 71, put onto the conveying path 73, conveyed by the carriage roller 74, put onto the feed path 75, abutted against a registration roller 76, and stopped. The registration roller 76 is subsequently rotated timed to the rotation of a toner image transferred onto the intermediate transfer belt 62. The sheet is fed into a nip portion between the intermediate transfer belt 62 and the secondary transfer roller 65.

When the start switch provided to the operation panel 79 is pressed, the photosensitive drum 2 rotates anticlockwise in the drawing and at the same time the intermediate transfer belt 62 travels and rotates in the arrow direction in the drawing. With the rotation of the photosensitive drum 2, the surface of the photosensitive drum 2 is uniformly charged first by the electric charger 1 in the charging device 100. Next, laser light L is applied in accordance with the read content read by the above-mentioned document reading device 53. Writing is performed by the laser writing device 52. An electrostatic latent image is formed on the surface of the photosensitive drum 2. Toner is subsequently attached to the electrostatic latent image by the developing device 3 to make the electrostatic latent image visible.

The toner image attached on the surface of the photosensitive drum 2 is primarily transferred onto the intermediate transfer belt 62 by the primary transfer roller 61. The tonner image transferred onto the intermediate transfer belt 62 is collectively transferred by the secondary transfer roller 65 of the secondary transfer device 67 onto the sheet sent to the nip portion between the intermediate transfer belt 62 and the secondary transfer device 67. The surface of the photosensitive drum 2 after image transfer is cleaned by removing residual toner by the cleaning device 60, neutralized by an unillustrated neutralization device, and prepared for next future image formation. Moreover, the surface of the intermediate transfer belt 62 after image transfer is cleaned by removing residual toner and paper powder by a belt cleaning device 66, and prepared for next future image formation.

On the other hand, the sheet after image transfer is conveyed by the belt-type conveying device 68 to be put in the fixing device 80. Heat and pressure is applied to the sheet by the fixing roller 82 and the pressing roller 84 via the fixing belt 83. A transfer image (toner image) is fixed onto the sheet. The sheet is subsequently ejected onto, for example, an unillustrated discharge tray attached to the apparatus body 50 through the discharge path 85. When recording is performed also on the back surface of the sheet using this copying machine, after recording is performed on one surface, the sheet is put into the duplex unit 88 through the reverse path 86, reversed here, conveyed through the re-feed path 87, guided to the feed path 75, and sent again to the nip portion between the intermediate transfer belt 62 and the secondary transfer roller 65. Another toner image formed on the photosensitive drum 2 and toner image primarily transferred onto the intermediate transfer belt 62 are similarly secondarily transferred also onto the back surface. The sheet is then ejected onto, for example, the unillustrated discharge tray.

Figure 2:
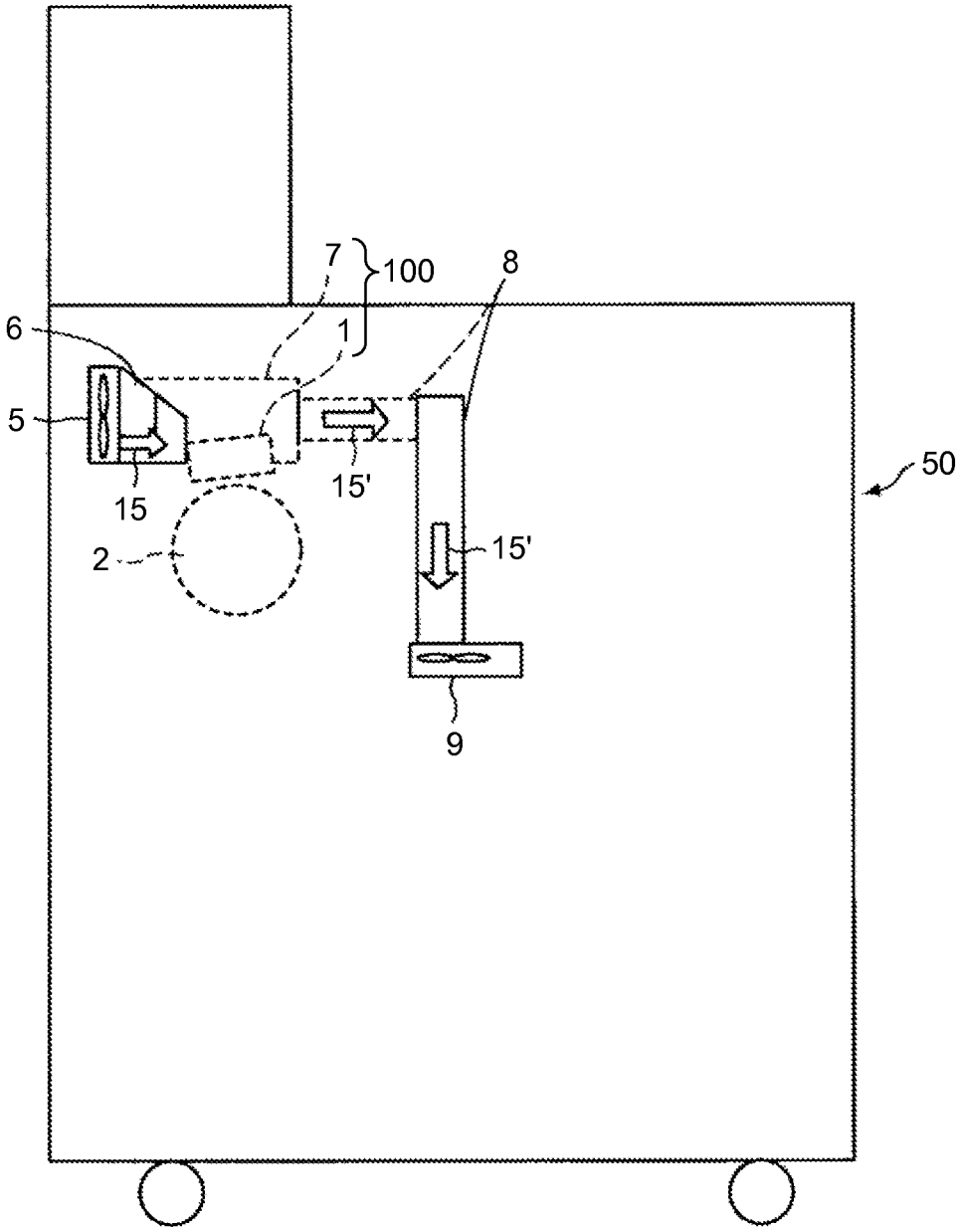
FIG. 2 is a rear view of main parts illustrating a duct path including an intake and an exhaust fans and a charging duct, which are arranged in the image forming apparatus of FIG. 1.

An intake and exhaust path around the charging device 100 will be described with reference to FIG. 2. FIG. 2 is a diagram when viewing main parts of the image forming apparatus of FIG. 1 from the rear (back), and is a diagram illustrating intake and exhaust fans and their duct paths.

In FIG. 2, a reference numeral 5 denotes an intake fan as an example of an intake unit that generates an intake airflow to be guided into the charging duct 7 arranged in the back side of the image forming apparatus body 50. The intake fan 5 is provided as a single unit, and communicates with/is connected to an intake fan duct 6 as an intake duct member to guide the generated intake airflow (hereinafter simply referred to also as the "airflow") to the charging duct 7.

The charging duct 7 communicates with/is connected to an exhaust fan duct 8 as an exhaust duct member. A single exhaust fan 9 as an example of an exhaust unit to exhaust the airflow (intake airflow) guided into the charging duct 7 is arranged on the most downstream side of the exhaust fan duct 8.

An airflow 15 generated by the operation of the intake fan 5 is guided into the charging duct 7 through the intake fan duct 6. The airflow 15 guided into the charging duct 7 becomes an exhaust airflow 15' by the operation of the exhaust fan 9. The exhaust airflow 15' is discharged/exhausted to the outside of the image forming apparatus body 50 through the exhaust fan duct 8. The exhaust fan duct 8 includes a filter to remove ozone, and the like that are provided at predetermined positions (meaning to be arranged and provided, or positioned and provided. The same shall apply hereinafter) as appropriate.

The layout arrangement and configurations of the charging device 100 and the photosensitive drum 2 will be described with reference to FIG. 3. FIG. 3 is a diagram partially sectioning and illustrating the layout arrangement in the front side of the charging device 100 with the photosensitive drum 2 as a center.

Figure 4A:
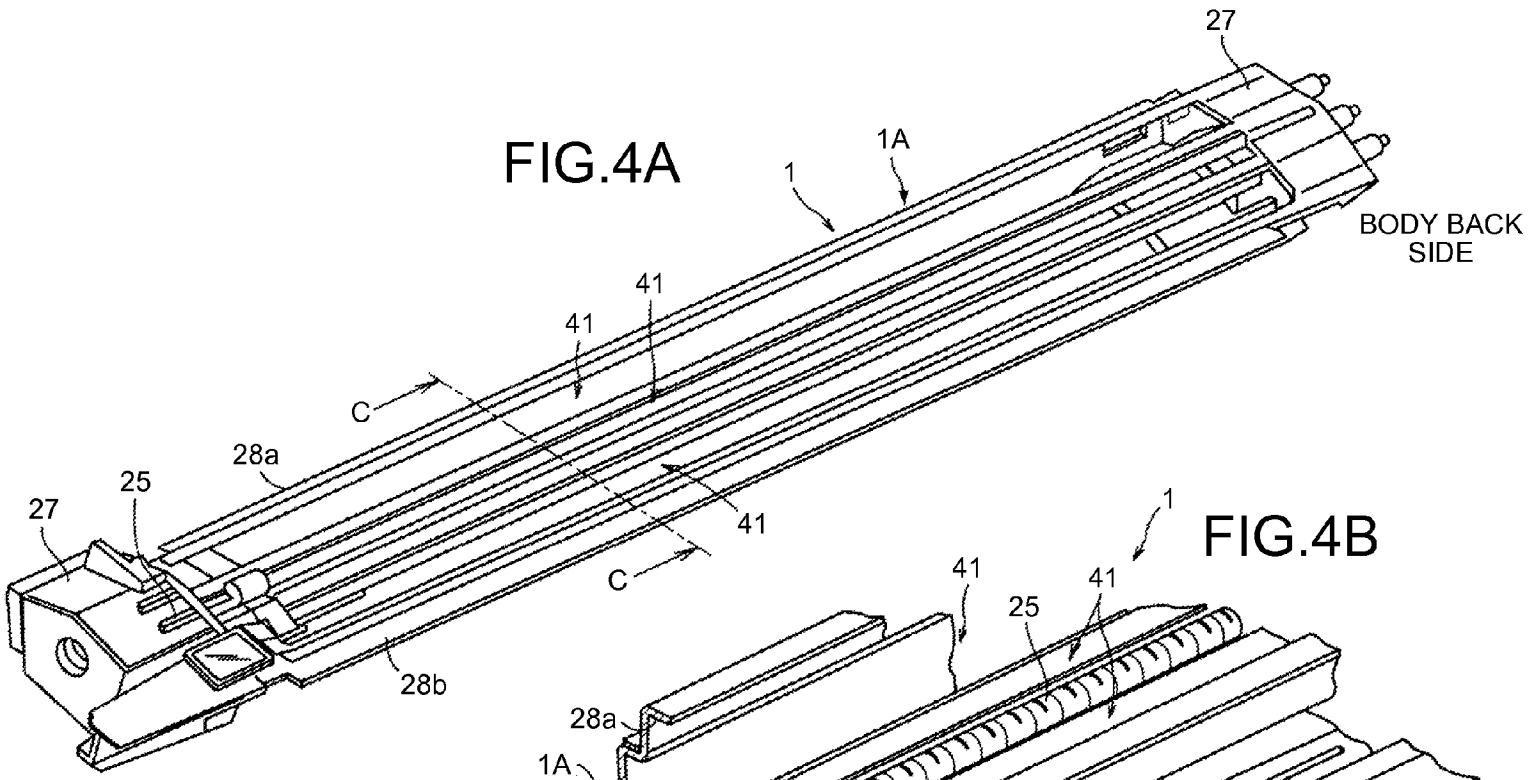
FIG. 4A is a perspective view when viewing an electric charger from diagonally above.
Figure 4B:
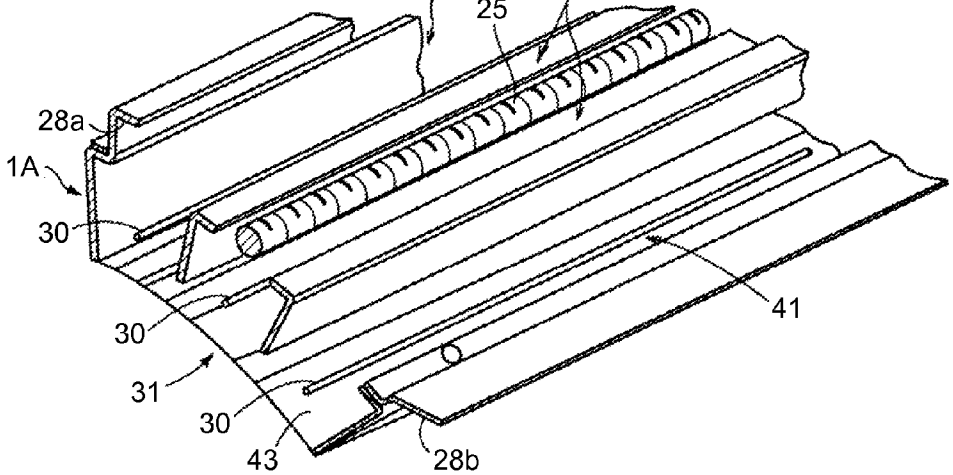
FIG. 4B is a perspective view enlarging and illustrating cross-section C-C of FIG. 4A.
Figure 6:
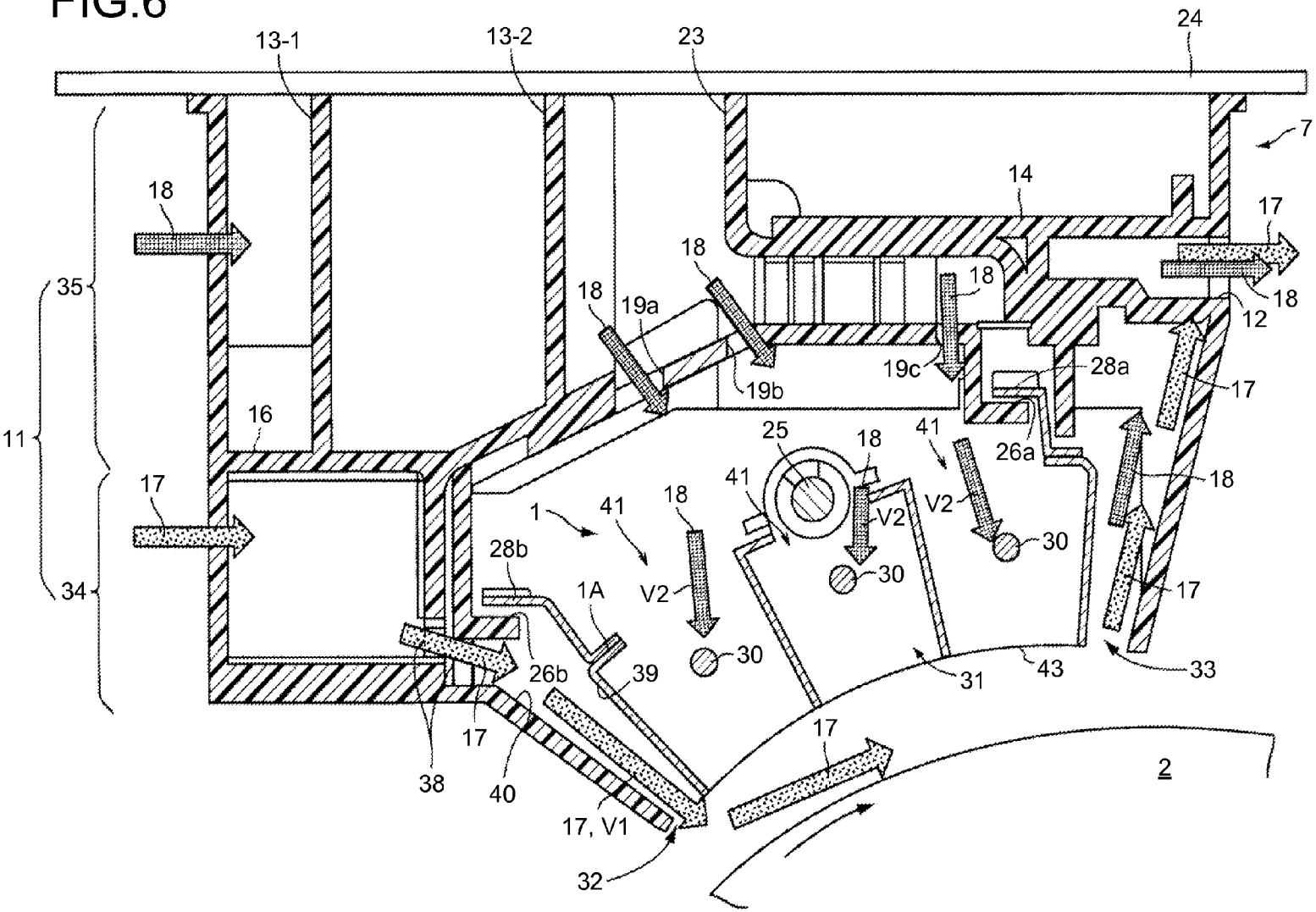
FIG. 6 is a cross-sectional view of main parts illustrating the shape of cross-section A-A of FIG. 5 and the flows of airflows.

The charging device 100 of the embodiment mainly includes the charging duct 7, and the electric charger 1 that is arranged in the charging duct 7, and that includes discharge wires 30, illustrated in FIGS. 4A, 4B, 6, and the like, that charge the outer peripheral surface of the photosensitive drum 2.

The electric charger 1 has a function as a charging device body of the present invention, and is arranged in the vicinity above the photosensitive drum 2. The electric charger 1 is held by the charging duct 7. The charging duct 7 is arranged so as to surround the entire electric charger 1 from above, and has a role in diverting and flowing the intake airflow sent from the intake fan 5, to the electric charger 1.

The charging duct 7 is integrally formed of an appropriate resin, and configured to be detachable from the image forming apparatus body 50. The top of the charging duct 7 is attached in a state of being covered with a body metal sheet 24 being a thin plate-shape member provided at a predetermined position on the image forming apparatus body 50. The details of attachment of the charging duct 7 to the image forming apparatus body 50 are described below with reference to FIGS. 14 and 15. In the attachment of the charging duct 7 and the body metal sheet 24, a location that requires sealing property is sealed with a sealing member.

The electric charger 1 is configured to be detachable from the charging duct 7. A charger body 1A of the electric charger 1 is formed of sheet metal such as stainless steel being conductive metal as a shield member. As illustrated also in FIGS. 3, 4A, 4B, and 6, sheet-metal held portions 28*a* and 28*b* formed by extending upward from left and right outer walls of the charger body 1A are integrally attached to the charger body 1A to attach and remove the electric charger 1.

On the other hand, holding portions 26*a* and 26*b* formed on the left and right by extending in the axis line direction (which is also the longitudinal direction) of the photosensitive drum 2 are integrally formed in the charging duct 7.

The held portions 28*a* and 28*b* of the charger body 1A are held by the holding portions 26*a* and 26*b* of the charging duct 7 and accordingly the electric charger 1 can be attached and removed, in other words, inserted into and removed from the charging duct 7 in the longitudinal direction of the discharge wire 30 (the direction penetrating the page space). Consequently, the electric charger 1 is drawn out from the charging duct 7, and replacement, maintenance and cleaning work, and the like of the electric charger 1 can be easily performed.

A member denoted by a reference numeral 25 is a feed screw, and is provided to clean the discharge wires 30 constituting the electric charger 1 and a grid 43 illustrated in FIGS. 4A and 4B.

A detailed configuration of the electric charger 1 will be described with reference to FIGS. 4A and 4B. FIGS. 4A and 4B are perspective views when viewing the electric charger 1 from diagonally above.

The electric charger 1 is a scorotron charger including the charger body 1A, the discharge wires 30, the grid 43, and insulating support members 27, as illustrated in FIGS. 4A, 4B, and the like. The charger body 1A is provided across the longitudinal direction of the discharge wires 30 so as to partition each of the discharge wires 30. The discharge wire 30 functions as an example of a discharge electrode that charges the surface of the photosensitive drum 2 uniformly, and a plurality of (three in the embodiment) the discharge wires 30 is arranged at predetermined positions.

Both end portions of the charger body 1A are supported/fixed by the insulating support members 27. An end portion of the discharge wire 30 is engaged and fixed by a power feed contact (not illustrated) provided in the insulating support member 27. A high voltage is applied to the discharge wire 30 by a high-voltage power supply (not illustrated) via the unillustrated power feed contact.

The electric charger 1 is also called a charging device.

The grid 43 is formed into a mesh of stainless steel with a thickness of 0.1 mm, and functions as a discharge current control member. In other words, the grid 43 has the job of uniforming a discharge from the discharge wire 30 and charging the outer surface of the photosensitive drum 2. The grid 43 is formed into a curve with a predetermined space in between with the outer peripheral surface of the photosensitive drum 2, and integrally attached to the bottom of the charger body 1A that partitions beneath the discharge wires 30.

Opening holes 41 are formed at the top of the charger body 1A that partitions beneath the discharge wires 30. An opening portion 31 is formed at the bottom of the charger body 1A with the mesh grid 43 that permits airflow through. In other words, the opening holes 41 formed at the top of the charger body 1A communicate with the mesh grid 43 attached to the bottom of the charger body 1A.

Figure 5:
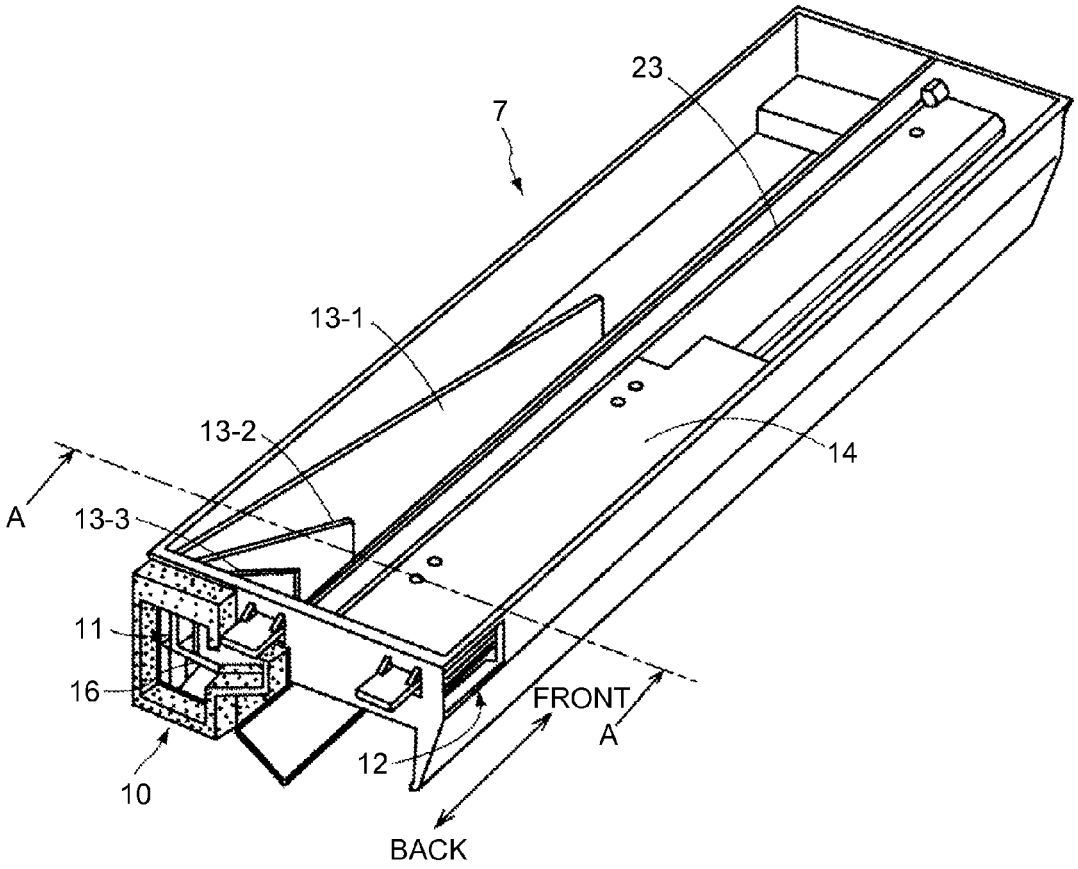
FIG. 5 is a perspective view when viewing the charging duct from the back side.
Figure 7:
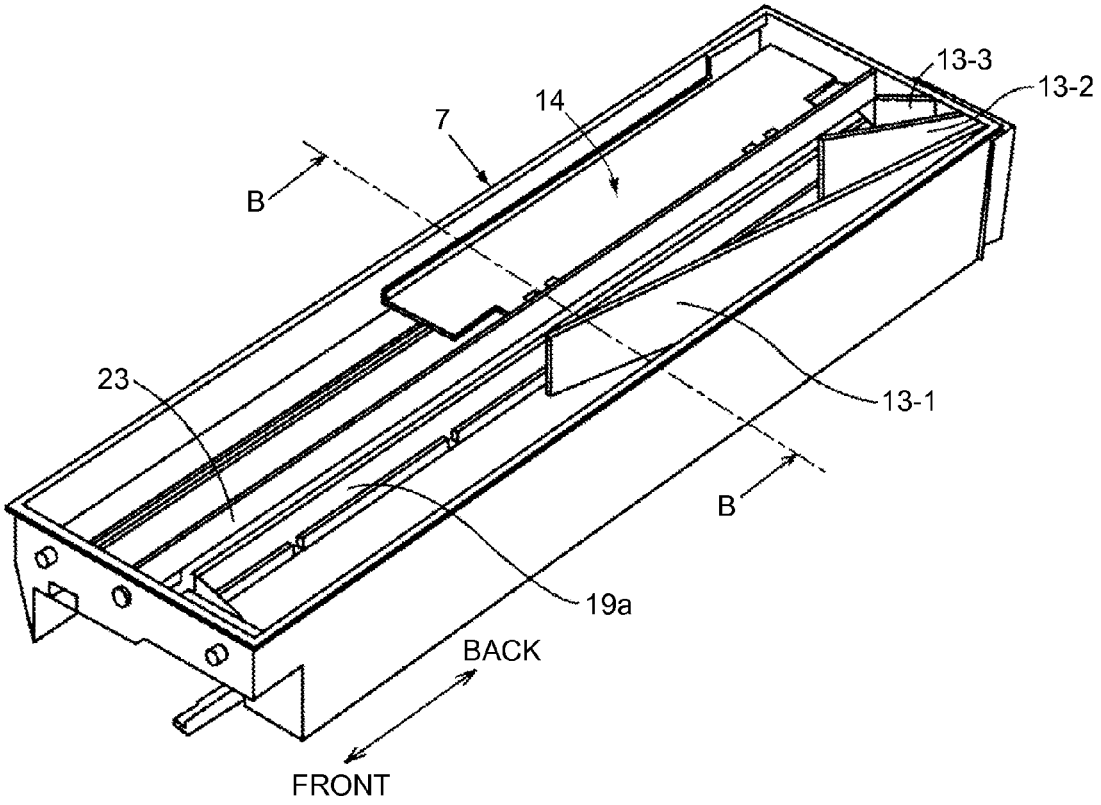
FIG. 7 is a perspective view when viewing the charging duct from the front side.
Figure 8:
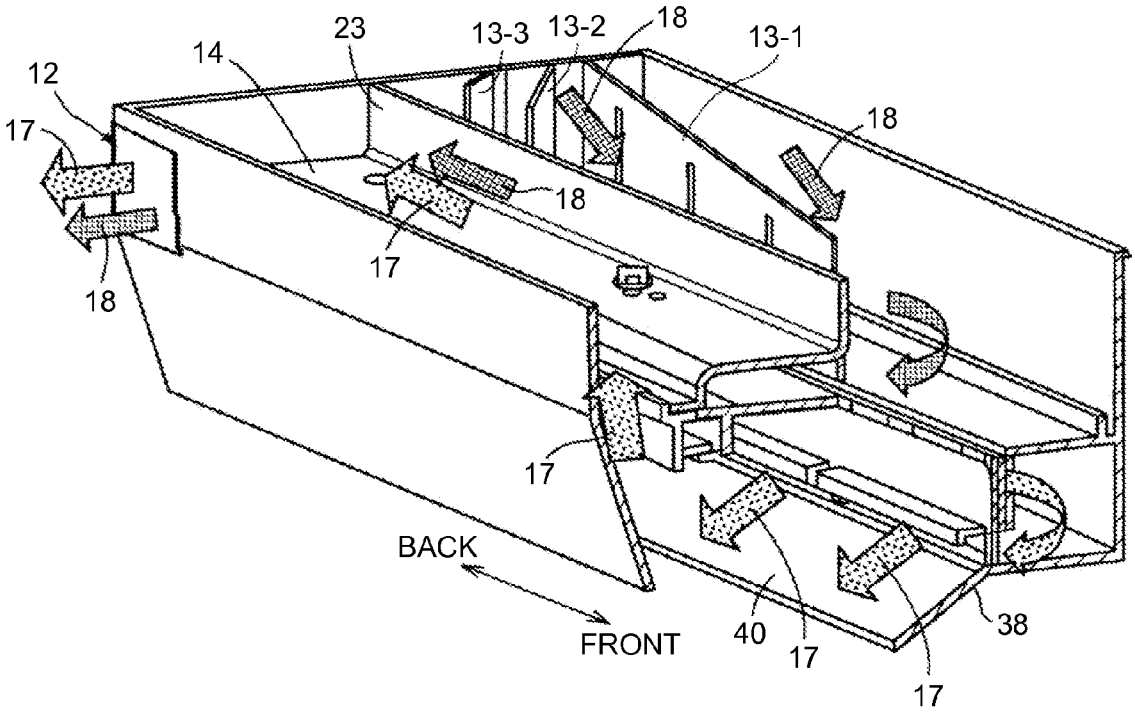
FIG. 8 is a partial cross-sectional perspective view illustrating the shape of cross-section B-B of FIG. 7 and the flows of airflows.
Figure 9:
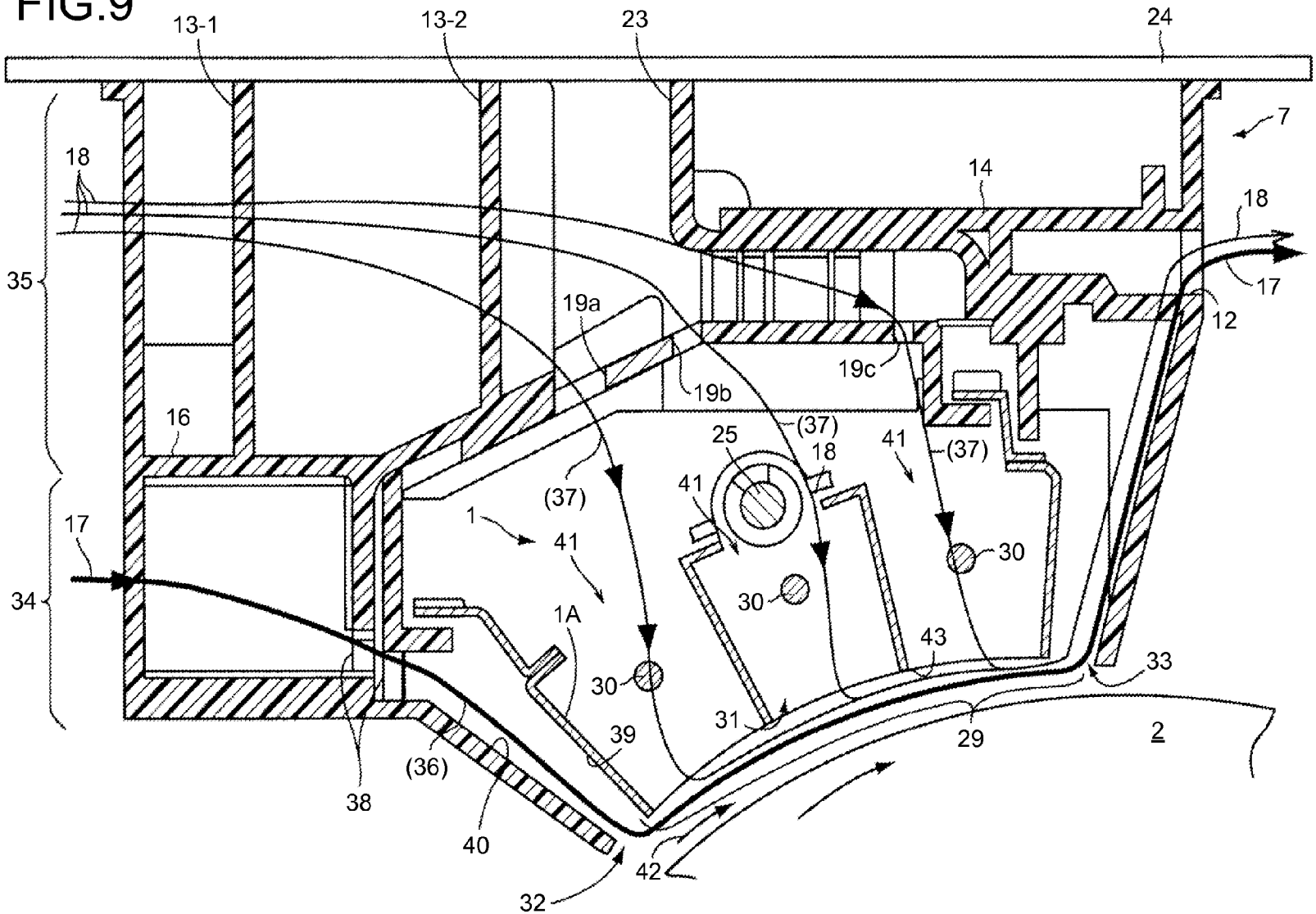
FIG. 9 is a cross-sectional view of the charging duct illustrating upper and lower airflow paths from the back side.
Figure 10:
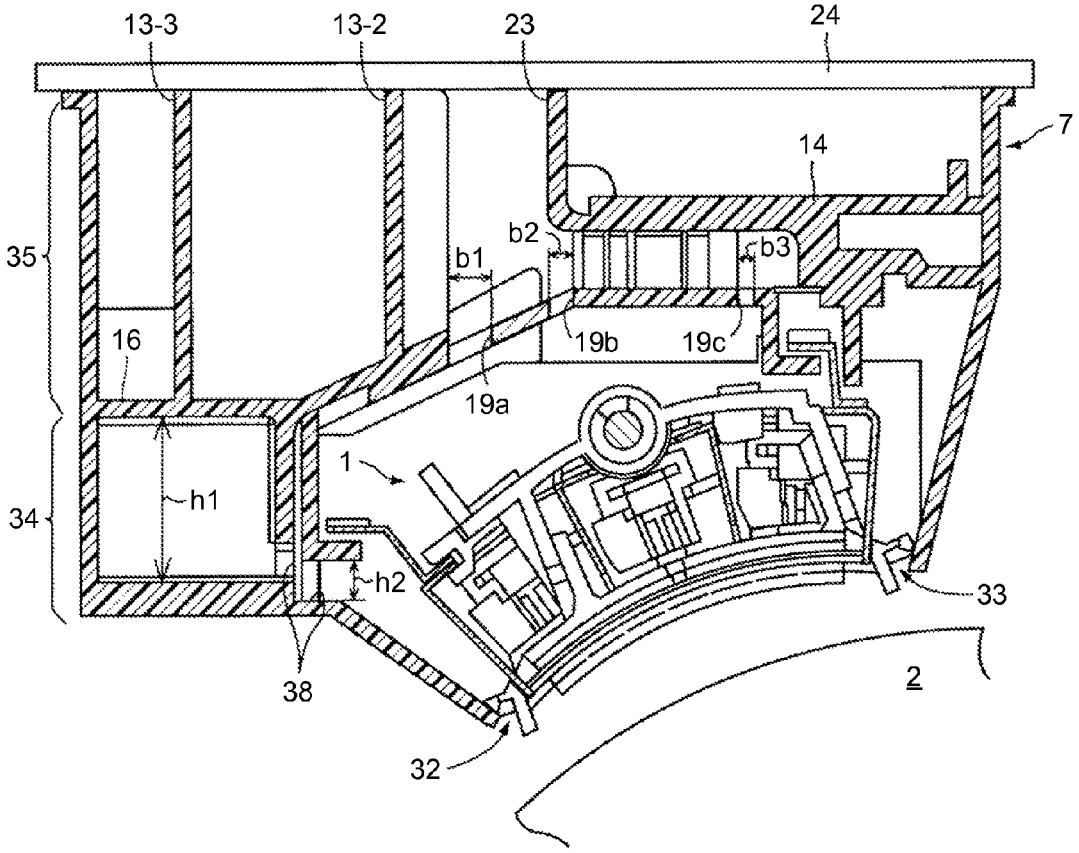
FIG. 10 is a cross-sectional view illustrating duct heights on the lower airflow path of, and width dimensions of slit holes in the upper airflow path of the charging duct.
Figure 11:
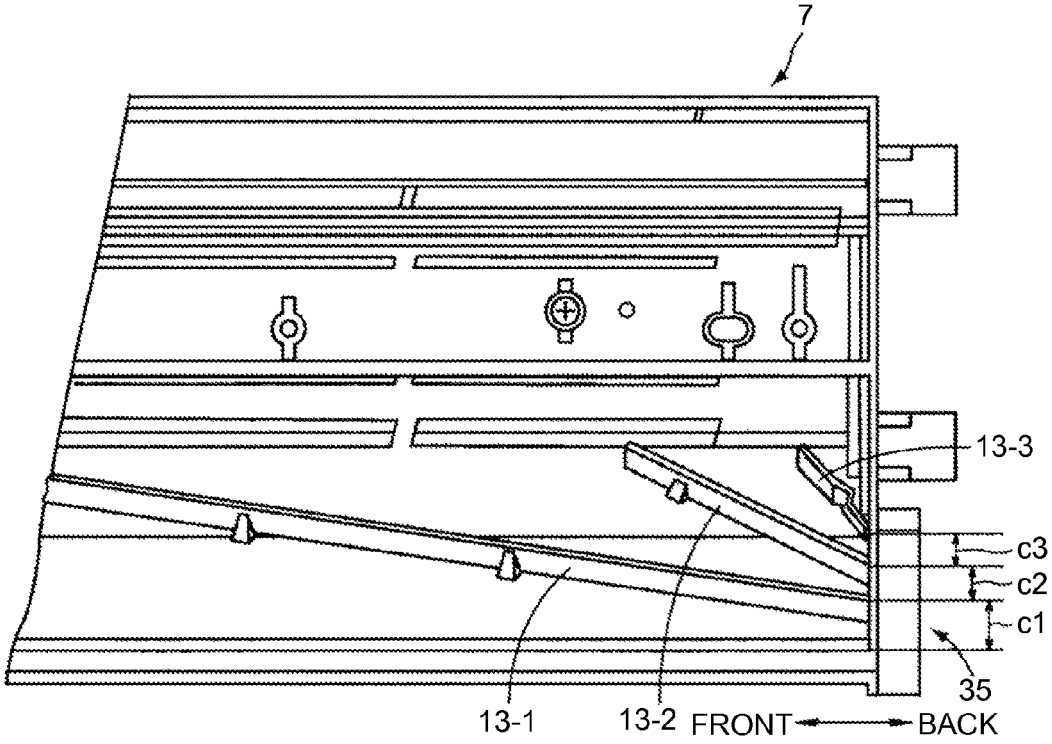
FIG. 11 is a plan view illustrating entry widths on a suction port side of partition plates of the charging duct.

The detailed configuration and operation of the charging duct 7 will be described with reference to FIGS. 5 to 11. FIG. 5 is a diagram when viewing the charging duct 7 from the back side. FIG. 6 is a diagram illustrating the shape of cross-section A-A of FIG. 5, and the flows of airflows. FIG. 7 is a diagram when viewing the charging duct 7 from the front side. FIG. 8 is a diagram illustrating the shape of cross-section B-B of FIG. 7, and the flows of airflows. FIG. 9 is a diagram when viewing the charging duct 7 illustrating upper and lower airflow paths from the back side. FIG. 10 is a diagram illustrating duct heights on the lower airflow path of, and width dimensions of slit holes 19*a*, 19*b*, and 19*c* of the upper airflow path of the charging duct 7. FIG. 11 is a diagram illustrating entry widths of partition plates 13-1, 13-2, and 13-3 of the charging duct 7 on a suction port side.

As illustrated in FIGS. 5 to 9, it is configured such that the intake airflow enters from an intake port 11 of the charging duct 7 and exits from an exhaust port 12. A sponge duct 10 is attached around the intake port 11 to prevent an intake leak upon connection with the intake fan duct 6 illustrated in FIG. 2. The sponge duct 10 is described in detail below.

As illustrated in FIGS. 6 and 9, the charging duct 7 is configured to surround the entire opening portion 31 of the charger body 1A excluding an opposed opening portion opposed to the surface of the photosensitive drum 2 at the opening portion 31 of the charger body 1A, and to be capable of introducing and exhausting the intake airflow within the surrounded area. The charging duct 7 includes an airflow wall forming unit (hereinafter referred to also as the "air barrier forming unit") that covers, with an air wall (air barrier) 29 of an intake airflow 17, the entire opening portion 31 (technically the opposed opening portion) from an upstream end in the rotation direction (clockwise in FIG. 6) of the photosensitive drum 2 at the opening portion 31 of the charger body 1A to a downstream end in the rotation direction of the photosensitive drum 2 at the opening portion 31.

The airflow wall forming unit (air barrier forming unit) includes an intake exit 32 formed between the charger body 1A and the charging duct 7, which are on the upstream end portion side in the rotation direction (clockwise in FIG. 6) of the photosensitive drum 2 at the opening portion 31, and an exhaust entry 33 formed between the charger body 1A and the charging duct 7, which are on the downstream end portion side in the rotation direction of the photosensitive drum 2 at the opening portion 31.

The intake exit 32 and the exhaust entry 33 are formed across the length direction of the discharge wire 30 and the opening portion 31.

The intake port 11 being an entry of the intake airflow of the charging duct 7 is divided by a partition plate 16 into two of a lower intake port 34 as a first intake port and an upper intake port 35 as a second intake port. The intake airflow 17 (hereinafter referred to also as the "airflow 17") being part of the intake airflow 15 generated by the intake fan 5 illustrated in FIG. 2 is sent into the lower intake port 34, and an intake airflow 18 (hereinafter referred to also as the "airflow 18") being part of the intake airflow 15 generated by the intake fan 5 illustrated in FIG. 2 is sent into the upper intake port 35. The intake ports 34 and 35 communicate respectively with independent airflow paths formed independently in the charging duct 7.

Space above the partition plate 16 of the charging duct 7 is partitioned by a plurality of (three in the embodiment) the partition plates 13-1, 13-2, and 13-3. The three partition plates 13-1, 13-2, and 13-3 are provided to split the airflow 18 sent from the upper intake port 35 and distribute the airflow 18 uniformly in the longitudinal direction of the discharge wire 30.

A center wall 23 partitions the charging duct 7 into an intake area and an exhaust area. Furthermore, the exhaust area is partitioned by a partition plate 14.

As illustrated in FIGS. 3, 6, 9, and the like, the top of the charging duct 7 is attached so as to be in close contact with the body metal sheet 24 that serves as a cover (lid). It is also possible to provide a dedicated cover to the top of the charging duct 7. However, the body metal sheet 24 is used in the embodiment from viewpoint of ensuring space for layout and avoiding an increase in cost. The attachment surface of the body metal sheet 24 is sealed so as not to leak an airflow.

As described above, the charging duct 7 is substantially sealed excluding the intake port 11, the intake exit 32, and the exhaust entry 33.

In FIGS. 6, 8, and 9, as indicated by the flow of the airflow 17, the lower intake port 34 communicates with a lower airflow path 36 illustrated with a round bracket in FIG. 9, as one of the independent airflow paths (or a first independent airflow path) formed independently in the charging duct 7. In other words, the lower airflow path 36 is formed by a path from the lower intake port 34 to the exhaust port 12 through an opening hole 38 formed in a lower side duct wall, the intake exit 32, the airflow wall 29, and the exhaust entry 33. The lower airflow path 36 is formed closer to the surface side of the photosensitive drum 2 to form the airflow wall 29.

The lower airflow path 36 is formed using an outer wall surface 39 of the charger body 1A and an inner wall surface 40 of the charging duct 7. The outer wall surface 39 of the charger body 1A and the inner wall surface 40 of the charging duct 7 are provided while being inclined at an obtuse angle with respect to the surface of the photosensitive drum 2 so as to ensure the formation of the airflow wall 29.

In FIGS. 6, 8, and 9, as indicated by the flow of the airflow 18, the upper intake port 35 communicates with an upper airflow path 37 illustrated with a round bracket in FIG. 9, as the other independent airflow path (or a second independent airflow path) formed independently in the charging duct 7. In other words, the upper airflow path 37 is formed by a path that starts at the upper intake port 35, is split/introduced by the partition plates 13-1, 13-2, and 13-3, passes through the slit holes 19*a*, 19*b*, and 19*c* formed in the upper duct, the opening holes 41 formed in an upper wall of the charger body 1A, and the discharge wires 30, merges with the airflow wall 29, and leads to the exhaust port 12 from the exhaust entry 33.

In FIGS. 6 and 9, the magnitude of a flow velocity V1 of the airflow 17 flowing through the lower airflow path 36 is set to be greater than a flow velocity V2 of the airflow 18 flowing through the upper airflow path 37. Specifically, the flow velocity V1 of the airflow 17 is set to approximately 0.6 to 0.8 m/sec, and the flow velocity V2 of the airflow 18 to approximately 0.2 to 0.4 m/sec. There is no problem in the flow velocity V2 of the airflow 18 if a minimum airflow that permits the removal of ozone generated by the discharge wire 30 is ensured. Conversely, it is necessary for the airflow 17 to increase the flow velocity in order to prevent entry of foreign objects from the outside, especially foreign objects such as paper powder carried from the cleaning device 60 and the like due to the rotation of the photosensitive drum 2, the flying tonner from the developing device 3, and the like, into the charger body 1A.

In FIG. 10, in order to obtain the flow velocity V1 of the airflow 17, as a specific example, a duct height h1 forming the lower intake port 34 is set to 22 mm, and a duct height h2 on the downstream side forming the lower airflow path 36 to 5 mm. In this manner, the duct heights h1 and h2 are changed and accordingly the sectional area is progressively reduced toward the downstream side of the airflow 17.

In FIGS. 6 and 11, the partition plate 16 is inclined obliquely upward from the upstream side to the downstream side in the rotation direction of the photosensitive drum 2 and the airflow 18 is split so as to obtain the flow velocity V2 of the airflow 18 and distribute the airflow 18 uniformly in the longitudinal direction of the discharge wire 30. In this manner, the duct height above the partition plate 16 is changed and accordingly the sectional area is progressively reduced toward the downstream side of the airflow 18.

In addition, the shapes and width sizes of the slit holes 19*a*, 19*b*, and 19*c* are changed between the upstream side and the downstream side in the rotation direction of the photosensitive drum 2 based on the results of airflow simulations. If the width dimension of the slit hole 19*a* is set as b1, the width dimension of the slit hole 19*b* as b2, and the width dimension of the slit hole 19*c* as b3, the setting is performed such that b1>b2>b3 holds.

In FIG. 11, the entry widths of the partition plates 13-1, 13-2, and 13-3 at the upper intake port 35 are set to c1=8 mm, and c2=c3=6 mm while the sectional areas of the entries are set to c1 portion=175.2 $mm^2$, and c2 portion=c3 portion=131.4 $mm^2$. The balance of flow velocity in the longitudinal direction of the discharge wire 30 changes depending on such sectional areas of the entries, which has been confirmed in the airflow simulations.

The operation of the airflows 17 and 18 with the above configuration of the charging duct 7 will be described with reference to FIGS. 6 and 9. The airflow 17 sent out from the lower intake port 34 is increased in the flow velocity V1 due to the difference between the duct heights h1 and h2 (sectional areas) of the lower airflow path 36. Furthermore, the airflow 17 sent out from the intake exit 32 forms the airflow wall (air barrier) 29 covering the entire opening portion 31 from the intake exit 32 on the upstream end in the rotation direction (clockwise in FIG. 6) of the photosensitive drum 2 at the opening portion 31 to the exhaust entry 33 on the downstream end in the rotation direction of the photosensitive drum 2 at the opening portion 31. At this point, especially foreign objects such as toner and paper powder that fly from the cleaning device 60 of the photosensitive drum 2 and are carried by laminar flow 42 occurring due to the rotation of the photosensitive drum 2, zinc stearate to protect the surface of the photosensitive drum 2, and flying tanner from the developing device 3 are blocked by the airflow wall (air barrier) 29 and accordingly entry of foreign objects from the outside can be prevented.

On the other hand, the airflow 18 sent out from the upper intake port 35 is increased in the flow velocity V2 (smaller than the flow velocity V1 of the airflow 17) by the inclination of the partition plate 16 of the upper airflow path 37, and distributed uniformly in the longitudinal direction of the discharge wire 30 by the above settings of the intake entry widths of the partition plates 13-1, 13-2, and 13-3 and the slit holes 19*a*, 19*b*, and 19*c*.

From the above matters and FIGS. 6 and 9, the passage sectional area of the lower airflow path 36 is smaller than that of the upper airflow path 37.

The flow velocity V1 of the airflow 17 forming the airflow wall 29 is higher than the flow velocity V2 of the airflow 18 to be sent to the discharge wire 30 portion; accordingly, negative pressure is generated by Bernoulli's principle from the airflow 18 side to the airflow 17 side. Therefore, it is possible to cause the airflow 18 to move ozone generated around the discharge wire 30 to the photosensitive drum 2 side and to cause the airflow 17 to prevent foreign objects from the outside from attaching to the discharge wire 30.

With regard to a difference in airflow by the rotation of the photosensitive drum 2, it has been confirmed from the results of the airflow simulations that an influence of airflow by the rotation (linear velocity difference) of the photosensitive drum 2 is small. However, the flow velocity of the airflow 17 may be changed by the rotation (linear velocity difference) of the photosensitive drum 2.

Figure 12:
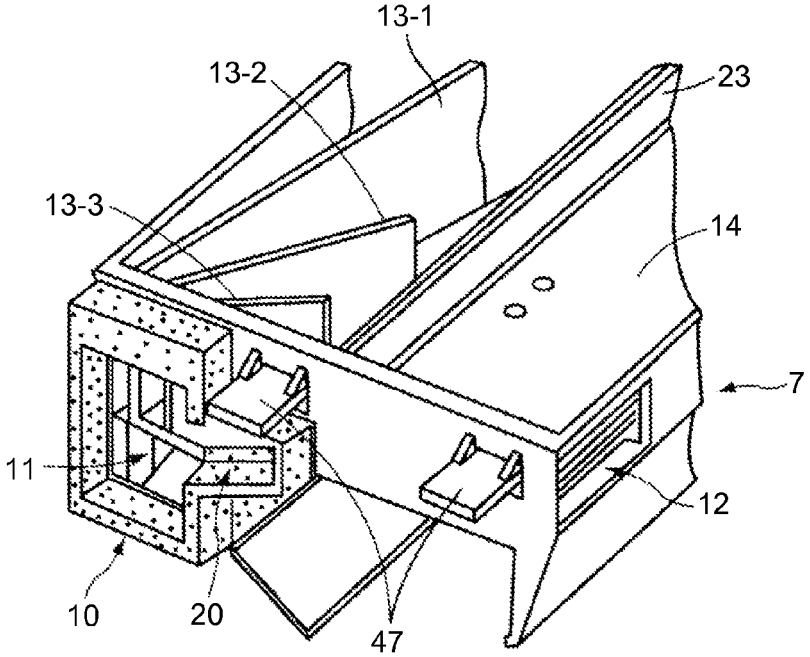
FIG. 12 is a perspective view illustrating a configuration example of an intake hole for a measure against backflow occurring in the charging duct and a sponge duct to guide an airflow to the intake hole.

As illustrated in FIG. 12, an intake hole 20 for backflow prevention is provided in the vicinity of the intake port 11 (the upper intake port 35) of the charging duct 7. If the intake hole 20 hole is not provided as in a charging duct 7' of a comparative example illustrated in FIG. 13A, space where the airflow 18 does not flow is created, and backflow occurs in this place. The details are described in a second embodiment to be described below. However, this is because the charging duct 7 has a tendency that it is difficult to ensure the uniform distribution of the airflow 18 across the longitudinal direction of the charging duct 7 in terms of the configuration where the upper intake port 35 of the upper airflow path 37 as well as the lower intake port 34 of the lower airflow path 36 is provided to the back side being one end side in the longitudinal direction of the charging duct 7.

Figure 13B:
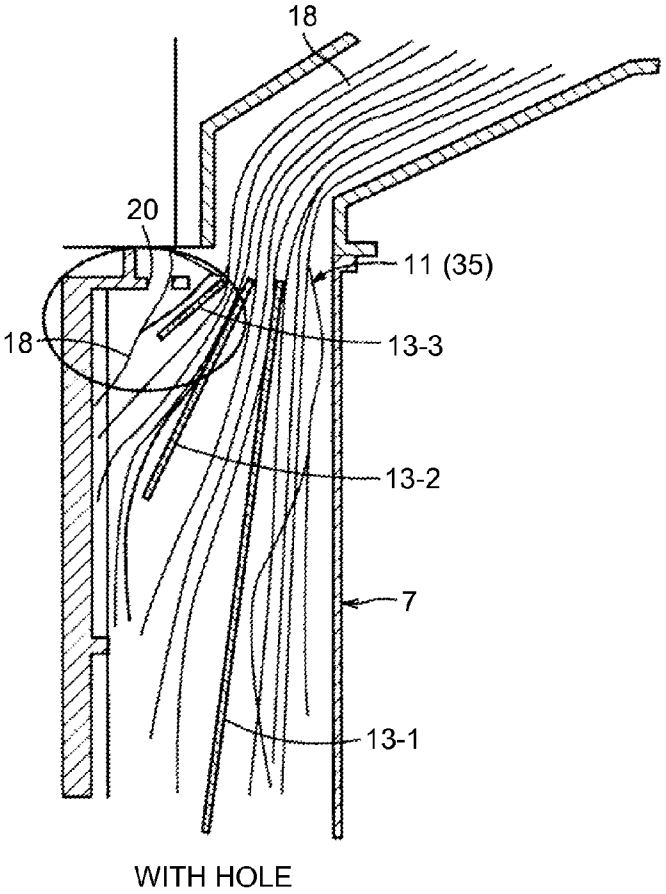
FIG. 13B is a cross-sectional plan view illustrating airflow simulation results for the first embodiment with the intake hole at the charging duct.
Figure 13A:
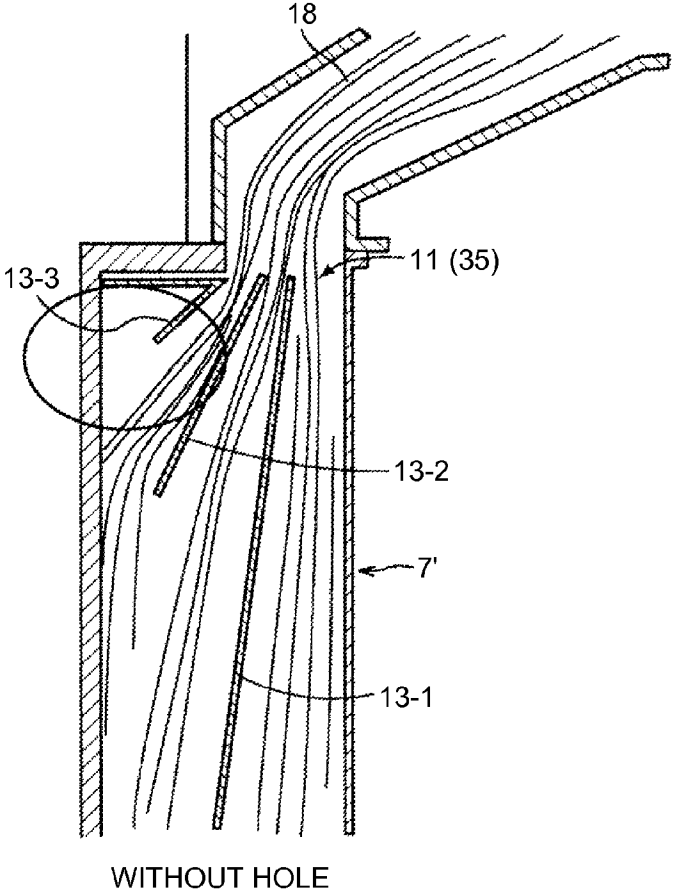
FIG. 13A is a cross-sectional plan view illustrating airflow simulation results for a comparative example without the intake hole at the charging duct.

As in the charging duct 7 of the first embodiment illustrated in FIG. 13B, the airflow 18 flows in by opening the intake hole 20 hole and therefore it is possible to cause the airflow 18 to flow to the discharge wire side. Consequently, the occurrence of backflow is prevented, which has been confirmed in the airflow simulations.

Moreover, the opening area of the exhaust port 12 of the charging duct 7 is smaller than that of the intake port 11 of the charging duct 7. Consequently, a foreign object collection force and a suction force to draw foreign objects to the exhaust fan duct 8 can be increased.

Figure 14:
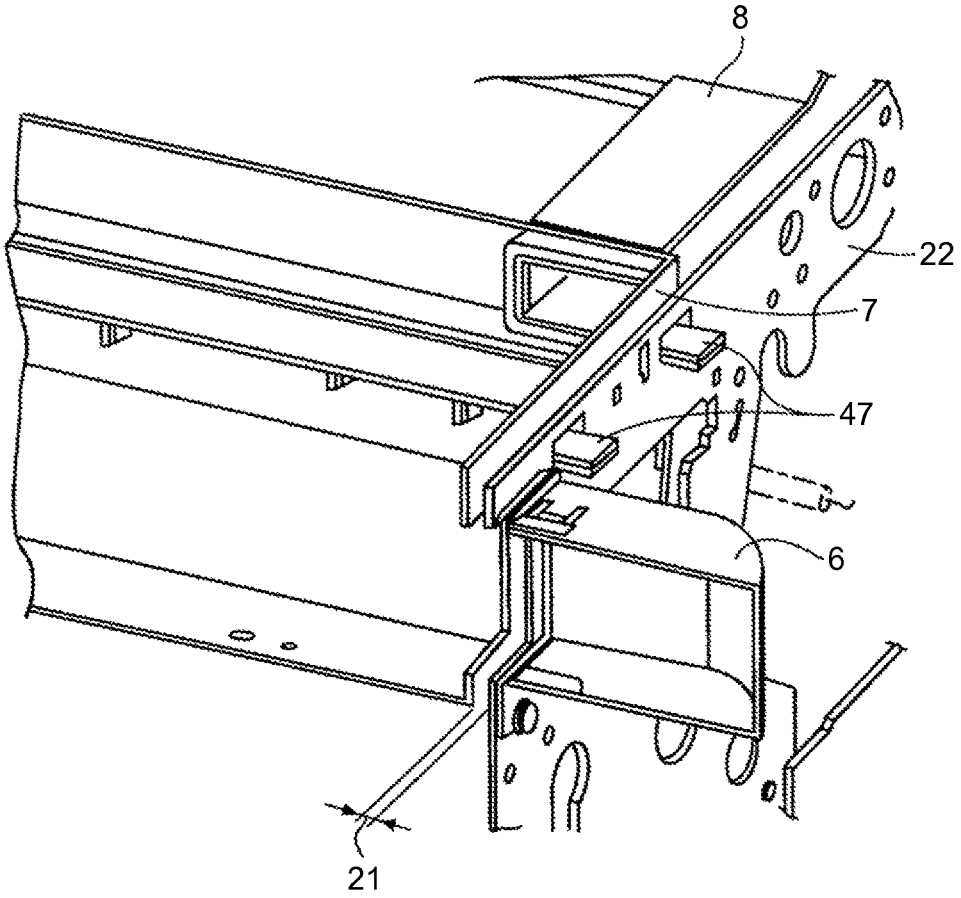
FIG. 14 is a perspective view, on the back side of an image forming apparatus body, of an intake duct and an exhaust duct that are connected to the charging duct.

As illustrated in FIGS. 12 and 14, the intake fan duct 6 on the image forming apparatus body 50 side communicates with the intake port 11 of the charging duct 7 via the sponge duct 10 as an example of an elastic foam body. Moreover, the exhaust fan duct 8 of the image forming apparatus body 50 side communicates with the exhaust port 12 of the charging duct 7 via an unillustrated sponge duct.

The sponge duct in FIG. 12 is held in a space 21 between a back side plate 22 on the image forming apparatus body 50 side in FIG. 14 and the charging duct 7. Therefore, there is an advantage that the shape of the intake fan duct 6 can be left as it is and the shape of the sponge duct can be changed in the space 21. It is important that the sponge duct 10 and the unillustrated sponge duct are used while provided with a crushing margin to prevent leakage of airflow.

Even if an intake hole is added to the charging device 100 at an optimal position, having the sponge duct 10 permits its flexible handling to a certain extent since the duct is a sponge form. In the embodiment, the intake port 11 of the charging duct 7 has a rectangular hole shape at the beginning, but a necessity to set an intake hole at an obliquely lateral position arose for a measure against backflow occurring in the charging duct 7. Accordingly, with the effect of the sponge duct 10 to release the airflow 18, the duct effect corresponding to the shape, in other words, the stagnation of the airflow 18 due to the backflow could be solved.

Figure 15:
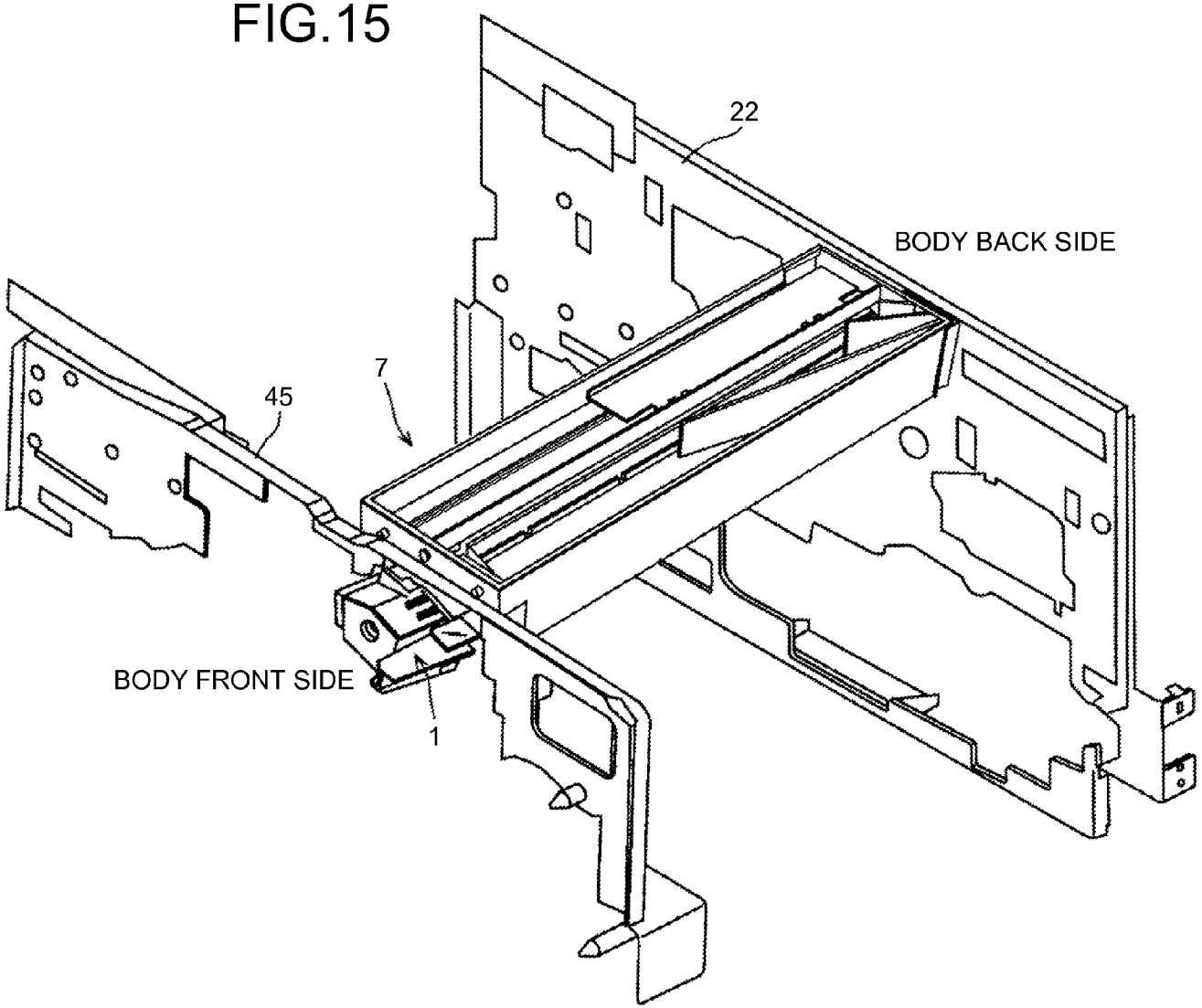
FIG. 15 is a perspective view illustrating methods of positioning and fixing the charging duct to the image forming apparatus body.

As illustrated in FIG. 15, the charging duct 7 is detachably fixed in a state of being sandwiched between a front side plate 45 and the back side plate 22 on the image forming apparatus body 50 side. As illustrated in FIGS. 12 and 14, two claws 47 for positioning that are fitted into holes formed in the back side plate 22 are integrally formed at an end portion at the body back side of the charging duct 7. The charging duct 7 is fixed to the front side plate 45 via a fastening unit (not illustrated) such as a screw. The two claws 47 are fitted into the holes in the back side plate 22 and accordingly the charging duct 7 is positioned and fixed to the back side plate 22.

Second Embodiment

Figure 16:
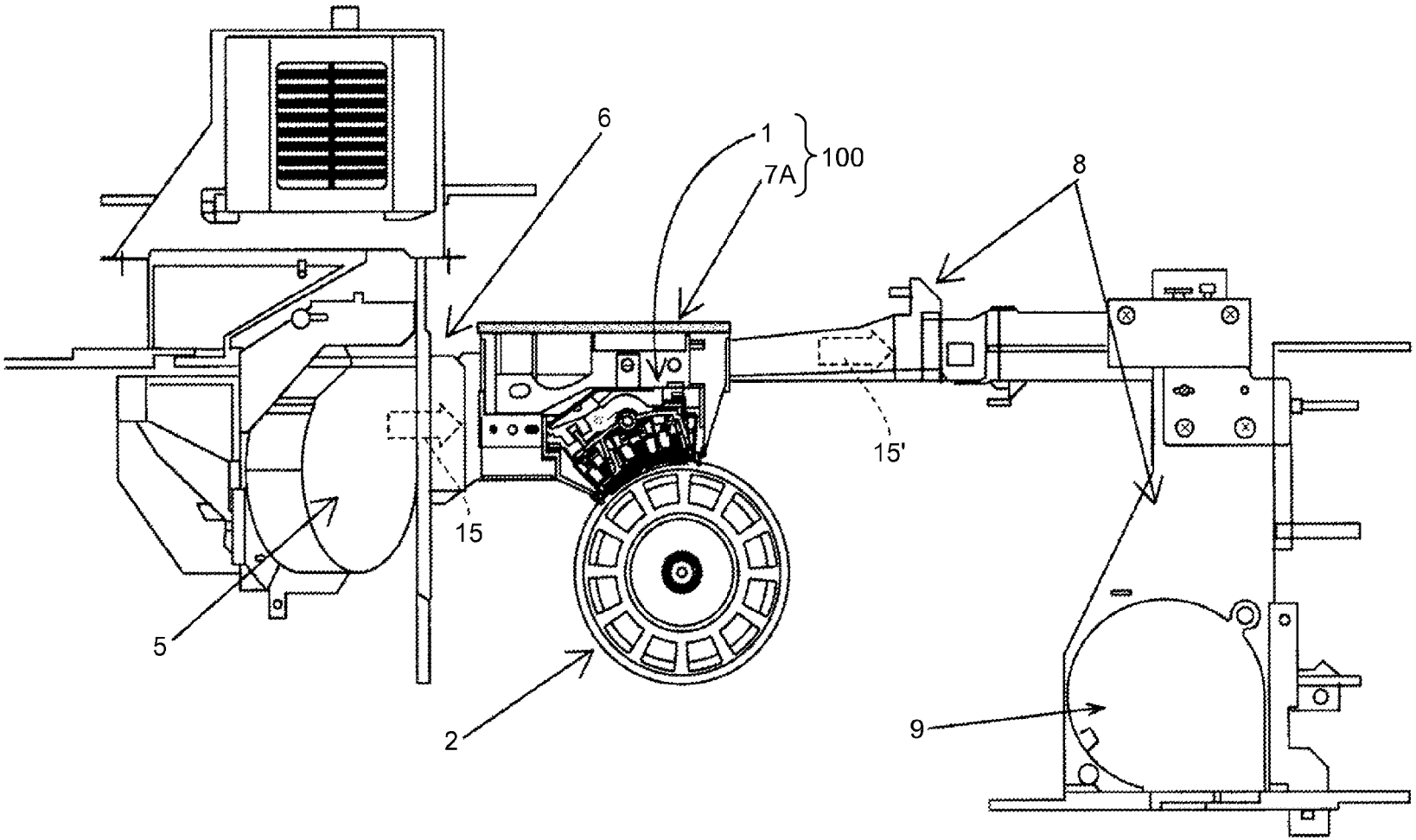
FIG. 16 is a perspective view of main parts illustrating a duct path including an intake and an exhaust fans and a charging duct, which are arranged in a charging device in an image forming apparatus illustrating a second embodiment.
Figure 17:
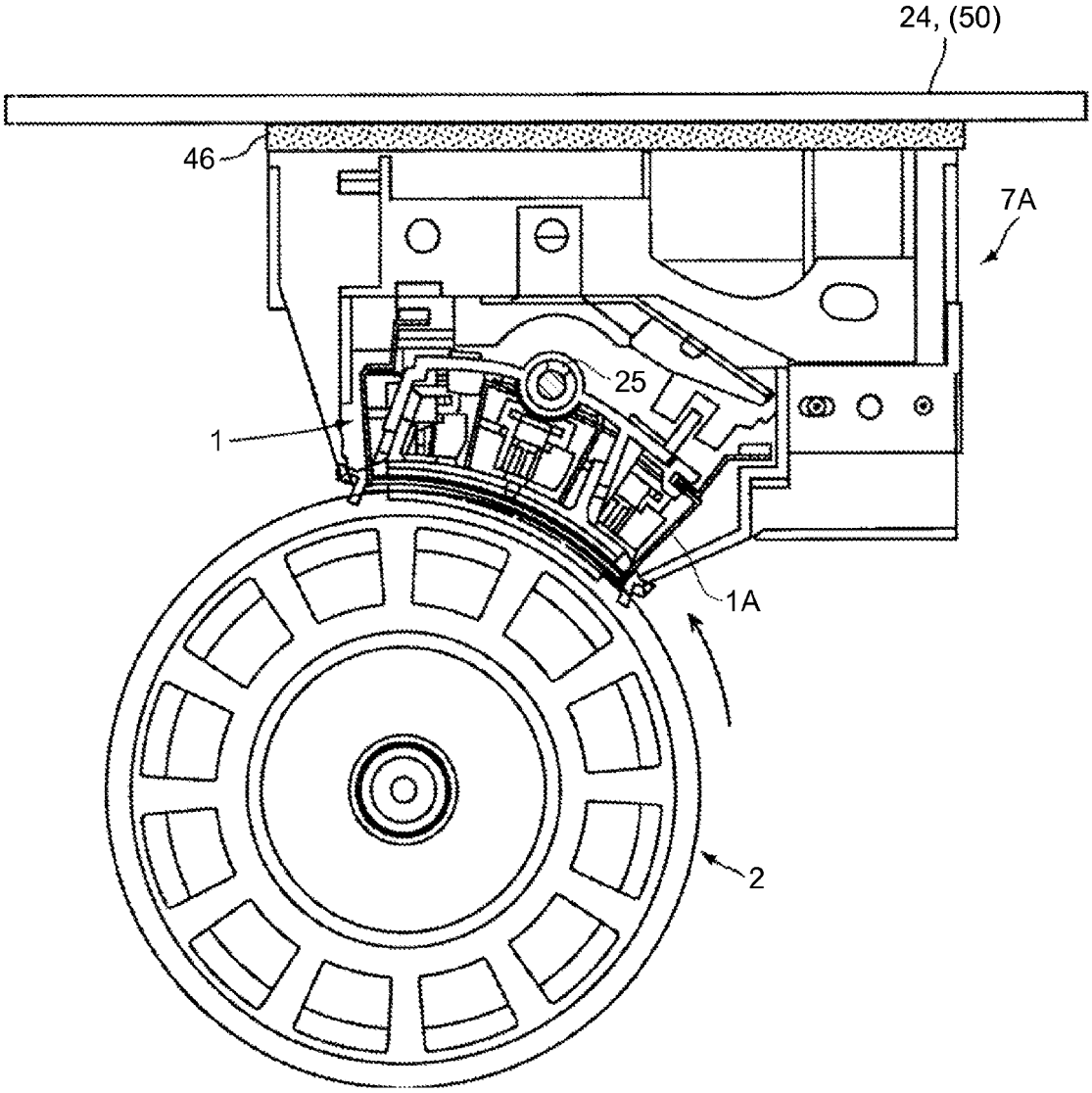
FIG. 17 is a partial cross-sectional front view illustrating layout arrangement in the front side of the charging device of the second embodiment with a photosensitive drum as a center.

The second embodiment of the present invention will be described with reference to FIGS. 16 to 29B. Firstly, the entire configuration of a charging device of the second embodiment will be described with reference to FIGS. 16 and 17. FIG. 16 is a perspective view of main parts illustrating a duct path including an intake and an exhaust fans and a charging duct, which are arranged in the charging device in an image forming apparatus illustrating the second embodiment. FIG. 17 is a partial cross-sectional front view illustrating layout arrangement in the front side of the charging device with a photosensitive drum as a center.

The second embodiment is different only in the point that as illustrated in FIGS. 16 and 17, a charging device 100A is used instead of the charging device 100 of the first embodiment illustrated in FIGS. 1 to 3. The charging device 100A mainly includes the electric charger 1 as in the first embodiment and a charging duct 7A unique to the second embodiment. Hereinafter, focusing on the charging duct 7A unique to the second embodiment, which is different from the first embodiment, configurations and operations thereof will be described. The common contents (the same configurations and operations) to both of the embodiments will be omitted as much as possible.

The configurations and operations of an intake and exhaust path around the charging device 100A can be easily understood and worked if the charging duct 7 and the charging device 100 are respectively read as the charging duct 7A and the charging device 100A in FIG. 2. In other words, as illustrated in FIG. 16, the intake airflow 15 generated by the operation of the intake fan 5 is guided into the charging duct 7A via the intake fan duct 6. The airflow 15 guided into the charging duct 7A becomes the exhaust airflow 15' by the operation of the exhaust fan 9, and the exhaust airflow 15' is discharged/exhausted to the outside of the image forming apparatus body 50 through the exhaust fan duct 8.

The layout arrangement and configurations of the charging device 100A and the photosensitive drum 2 will be described with reference to FIG. 17. FIG. 17 is a diagram partially sectioning and illustrating the layout arrangement in the front side of the charging device 100A with the photosensitive drum 2 as a center.

As in the first embodiment, a top of the charging duct 7A is attached in a state of being covered with the body metal sheet 24 provided at a predetermined position on the image forming apparatus body 50 illustrated with a bracket in FIG. 17. In the attachment of the charging duct 7A and the body metal sheet 24, in order to prevent leakage of airflow, a location that requires sealing property is sealed by affixing thereto a gap seal 46 including a sealing member such as a polyurethane sponge with double-sided tape. Specifically, a top table (a bottom wall portion of the laser writing device 52) of the laser writing device 52 illustrated in FIG. 1 is used as the body metal sheet 24.

Although the description gets out of order, sealing is performed in a similar method to the above also in the attachment of the charging duct 7 and the body metal sheet 24 of the first embodiment illustrated in FIG. 3.

The electric charger 1 is configured to be detachable from the charging duct 7A as in the first embodiment. In other words, in FIG. 20B, the holding portions 26*a* and 26*b* of the charging duct 7A are held by the held portions 28*a* and 28*b* of the charger body 1A and accordingly the electric charger 1 is detachable from the charging duct 7A in the longitudinal direction (a direction penetrating the page space) of the discharge wire 30. In other words, in FIGS. 3, 6, and 9, it can be easily understood if the charging duct 7 is read as the charging duct 7A.

The charging duct 7A is integrally formed of an appropriate resin, and part of the charging duct 7A is formed of sheet metal being a thin metal sheet. The charging duct 7A is configured to be detachable from the image forming apparatus body 50 similarly to the charging duct 7. The details of attachment of the charging duct 7A to the image forming apparatus body 50 are similar to those of the first embodiment described with reference to FIGS. 14 and 15. The charging duct 7 is read as the charging duct 7A in both of the figures.

Figure 18:
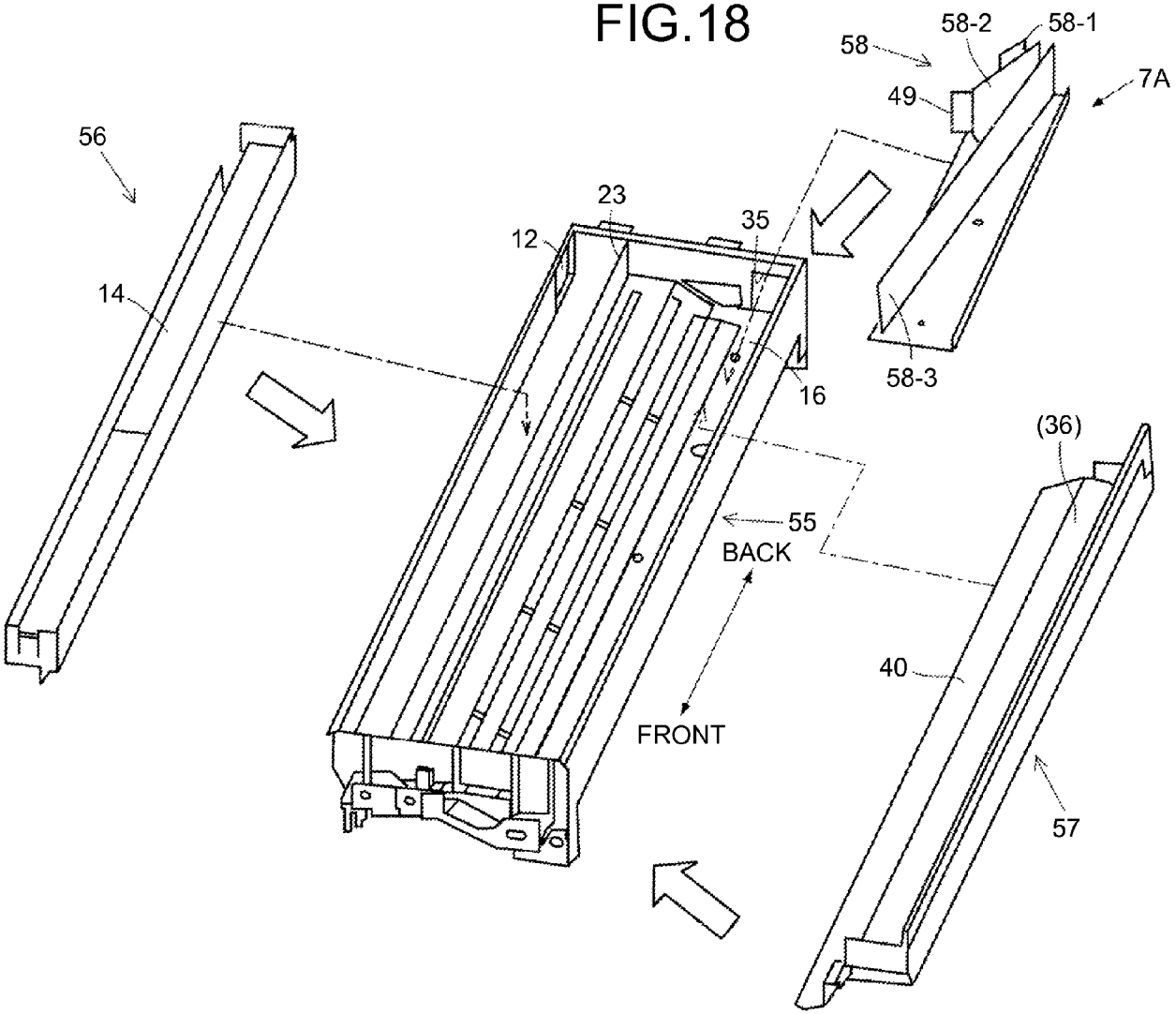
FIG. 18 is an exploded perspective view illustrating components of the charging duct of the second embodiment.

Components of the charging duct 7A will be described with reference to FIG. 18. FIG. 18 is an exploded perspective view illustrating the components of the charging duct 7A. As illustrated in the figure, the charging duct 7A includes four components of a duct body 55 for housing three components, which are described below, and the three components composed of an exhaust duct 56, an intake duct 57, and a partition plate 58.

The charging duct 7A is different from the charging duct 7 mainly in the points that a first guide plate 48 is integrally formed in the duct body 55 on the lower airflow path 36 side (see FIGS. 23B and 24B), that the intake duct 57 is used, and that the partition plate 58 including three sheet-metal partition plates 58-1, 58-2, and 58-3 is used instead of the resin partition plates 13-1, 13-2, and 13-3 illustrated in FIG. 5 and the like. Another difference is in the point that the partition plate 58-2 includes a second guide plate 49. The three sheet-metal partition plates 58-1, 58-2, and 58-3 provided to the upper airflow path 37 (illustrated with a round bracket) across the longitudinal direction of the charging duct 7A function as partition members of the present invention, and the second guide plate 49 as a second guide member for improvement in the balance of flow velocity and backflow prevention of the present invention. The configuration of the charging duct 7A is similar to the charging duct 7 other than these differences.

Conversely, the charging duct 7 of the first embodiment is assembled using the resin duct body 55 similar to the charging duct 7A without the first guide plate 48, the resin exhaust duct 56, the resin intake duct 57, the partition plate 13 including the resin partition plates 13-1, 13-2, and 13-3.

Figure 19:
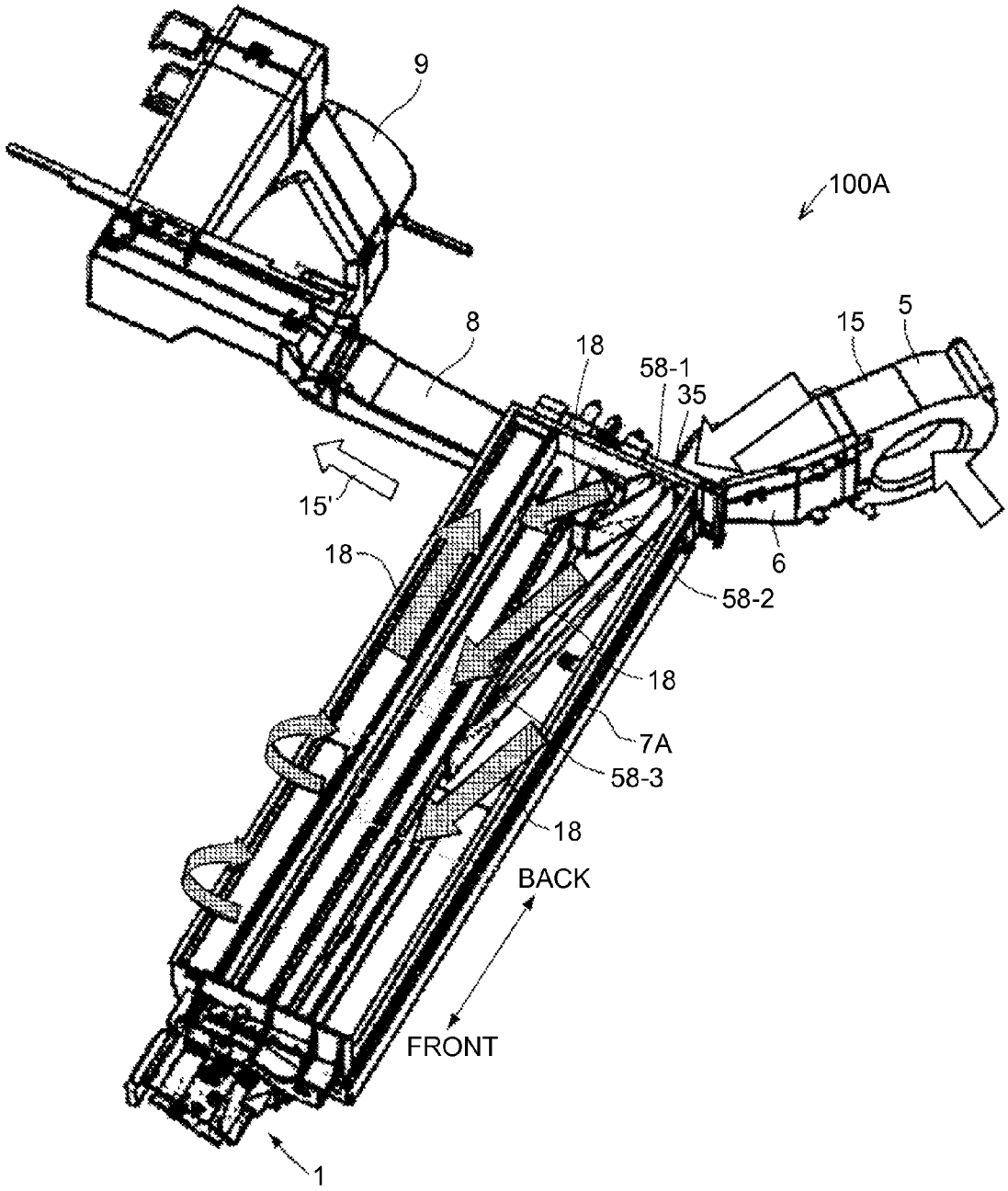
FIG. 19 is a perspective view illustrating an airflow flowing through an upper airflow path in the charging device of the second embodiment.
Figure 20B:
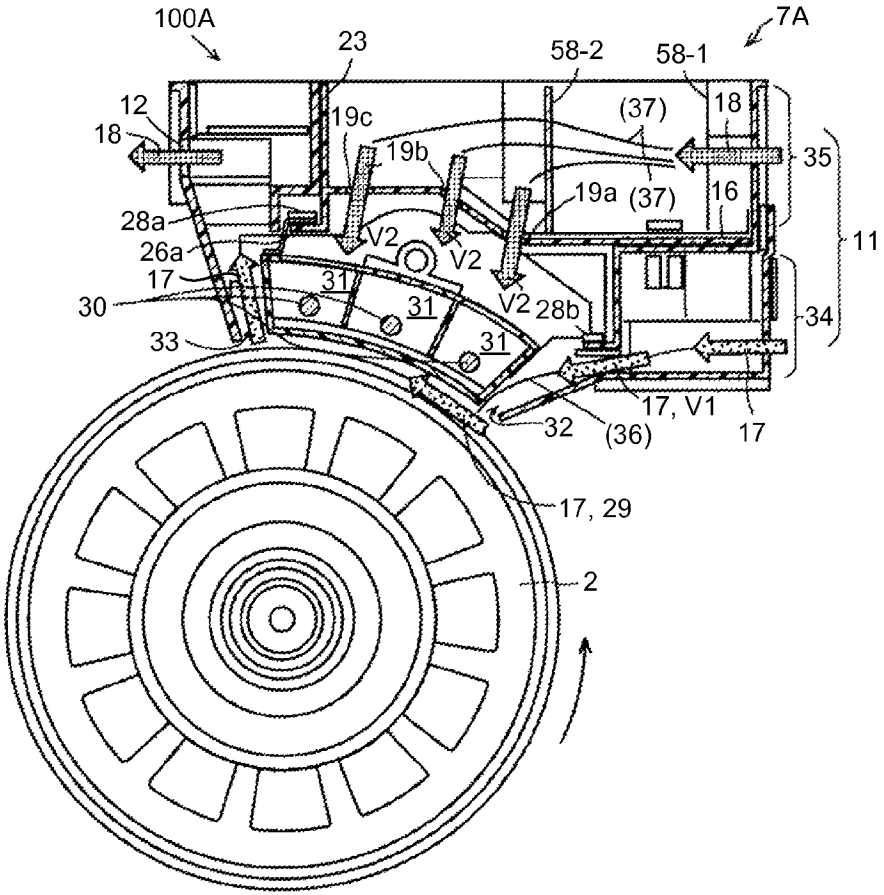
FIG. 20B is a cross-sectional view illustrating the shape of cross-section C-C of FIG. 20A and the flows of airflows.
Figure 20A:
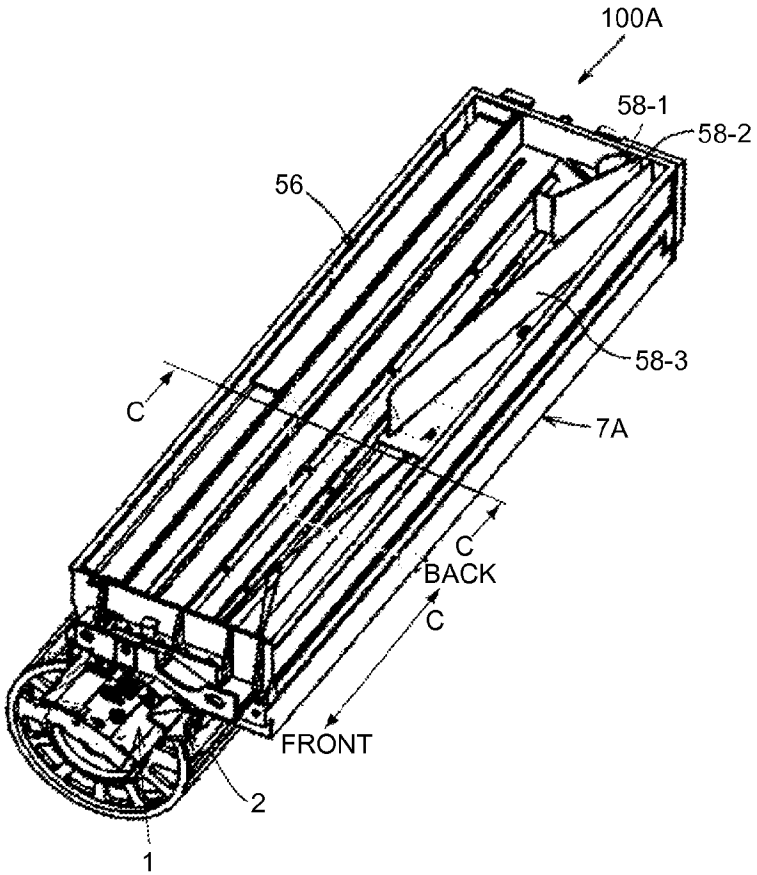
FIG. 20A is a perspective view when viewing the charging device and the charging duct of the second embodiment from the front side.
Figure 21:
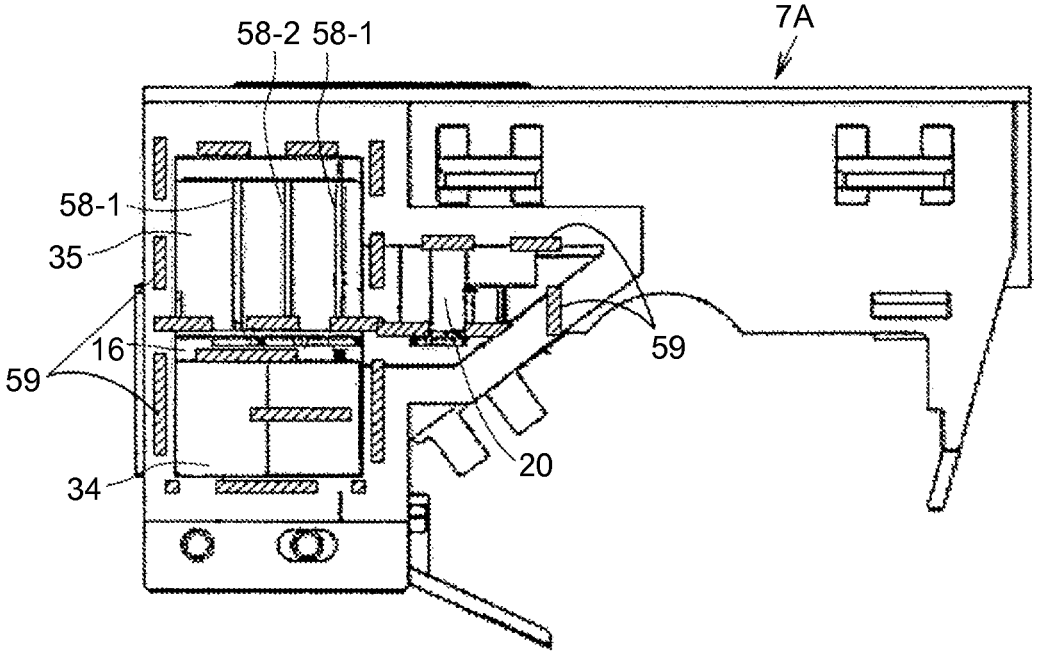
FIG. 21 is a rear view when viewing from the back side the charging duct of the second embodiment in a state where a sponge duct is removed.

Airflow paths and the flows of airflows in the charging device 100A will be described with reference to FIGS. 19, 20A, 20B, and 21. FIG. 19 is a perspective view illustrating the airflow 18 flowing through the upper airflow path 37 in the charging device 100A, and illustrates the charging duct 7A in a state where the illustration of the body metal sheet 24 illustrated in FIG. 17 is omitted. FIG. 20A is a perspective view when viewing the charging device 100A and the charging duct 7A from the front side, and FIG. 20B is a cross-sectional view of main parts illustrating the shape of cross-section C-C of FIG. 20A and the flows of airflows. FIG. 21 is a rear view when viewing, from the back side, the charging duct 7A in a state where the sponge duct 10 (see FIG. 5) is removed. In FIG. 21, a reference numeral 59 illustrating with a hatch denotes a location to which double-sided tape for affixing the sponge duct 10 (see FIG. 5) is affixed. Similar components to those of the first embodiment will be described citing the drawings described in the first embodiment, as appropriate.

As illustrated in FIGS. 19 to 21, the intake airflow 15 generated by the operation of the intake fan 5 is guided into the charging duct 7A via the intake fan duct 6. The airflow guided into the intake port 11 of the charging duct 7A is diverted by the lower intake port 34 and the upper intake port 35, which have been divided, into the airflow 17 that passes through the lower airflow path 36 illustrated with a round bracket and forms the airflow wall (air barrier) 29, and the airflow 18 that is sent to the discharge wire 30 through the upper airflow path 37 illustrated with a round bracket. At this point, the airflow 18 is sent while backflow is prevented by the intake hole 20.

The airflow 17 sent out from the lower intake port 34 is increased in the flow velocity V1 due to the difference between the duct heights h1 and h2 (the sectional areas, see FIG. 10) of the lower airflow path 36. Furthermore, the airflow 17 sent out from the intake exit 32 forms the airflow wall (air barrier) 29 covering the entire opening portion 31 from the intake exit 32 on the upstream end in the rotation direction (anticlockwise in FIG. 20B) of the photosensitive drum 2 at the opening portion 31 to the exhaust entry 33 on the downstream end in the rotation direction of the photosensitive drum 2 at the opening portion 31. These airflows 17 form similar flows in the longitudinal direction of the charging duct 7A.

On the other hand, the airflow 18 sent out from the upper intake port 35 is increased in the flow velocity V2 (smaller than the flow velocity V1 of the airflow 17) by the inclination of the partition plate 16 of the upper airflow path 37 and is distributed uniformly in the longitudinal direction of the discharge wire 30 by the above settings of the intake entry widths of the partition plates 58-1, 58-2, and 58-3 and the slit holes 19*a*, 19*b*, and 19*c*. These airflows 18 form similar flows in the longitudinal direction of the charging duct 7A.

Figure 22:
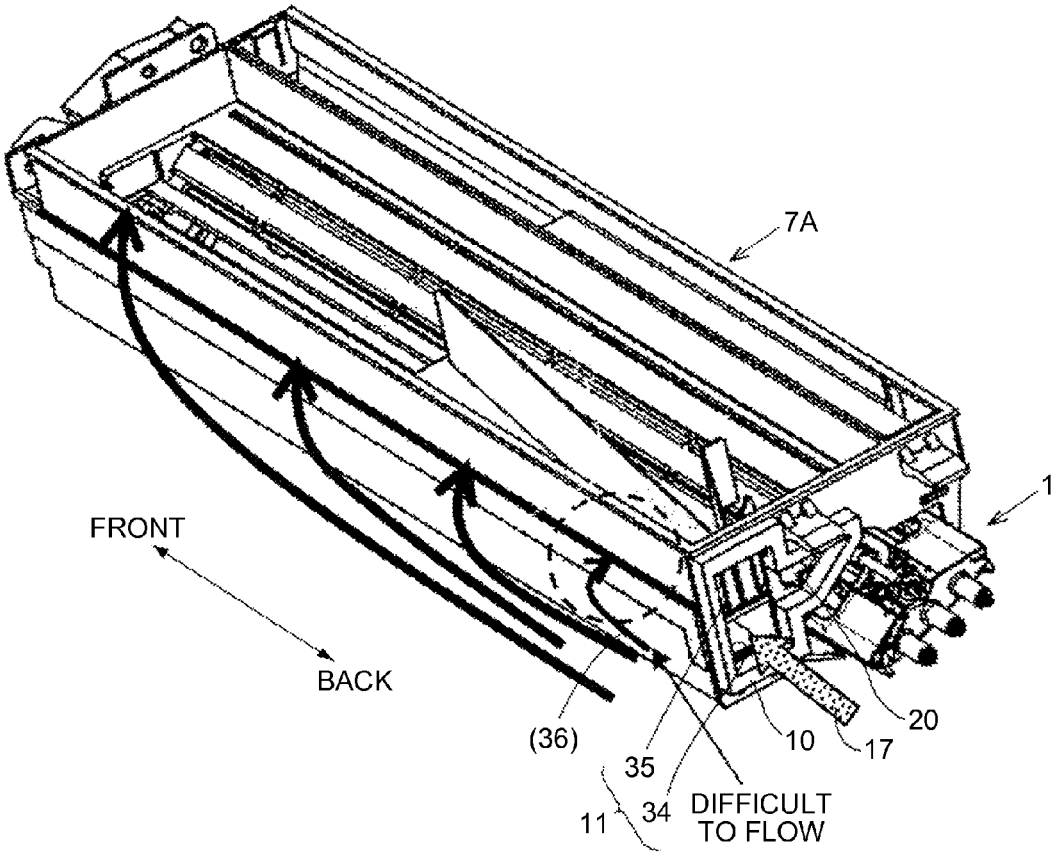
FIG. 22 is a perspective view when viewing the charging duct from the back side, illustrating the difficulty of the flow of an airflow in a longitudinal direction of the charging duct of the second embodiment.

The difficulty of the flow of the airflow 17 in the longitudinal direction (also the front and back direction) of the charging duct 7A will be described with reference to FIG. 22. FIG. 22 is a perspective view when viewing the charging duct 7A from the back side, illustrating the difficulty of the flow of the airflow 17 in the longitudinal direction of the charging duct 7A.

The charging duct 7A, including the charging duct 7 of the first embodiment, has a tendency that airflow is difficult to flow in the back side of the charging duct 7A as illustrated by being encircled by a broken line in FIG. 22 in terms of the configuration where the lower intake port 34 of the lower airflow path 36 is provided to the back side being the one end side in the longitudinal direction of the charging duct 7A. In short, there is a tendency that it is difficult to ensure the uniform distribution of the airflow 17 across the longitudinal direction of the charging duct 7. This tendency is a phenomenon that has been confirmed by many examinations for improvement in the charging duct 7 of the first embodiment.

As illustrated in FIG. 18, with the first guide plate 48 as the first guide member and the second guide plate 49 as the second guide member, which have been added in two locations, the difficulty of the flow of an airflow in the back side of the charging duct 7A is improved, and improvement in the balance of flow velocity and backflow prevention are promoted. The first guide plate 48 is one to deal mainly with the unbalance of flow velocity of the airflow 17 of the lower airflow path 36 in the vicinity of the entry of the lower intake port 34 in FIG. 22. Hereinafter, the arrangement locations, shape dimensions, and the like of the first guide plate 48 and the second guide plate 49 will be described in detail.

Figure 23B:
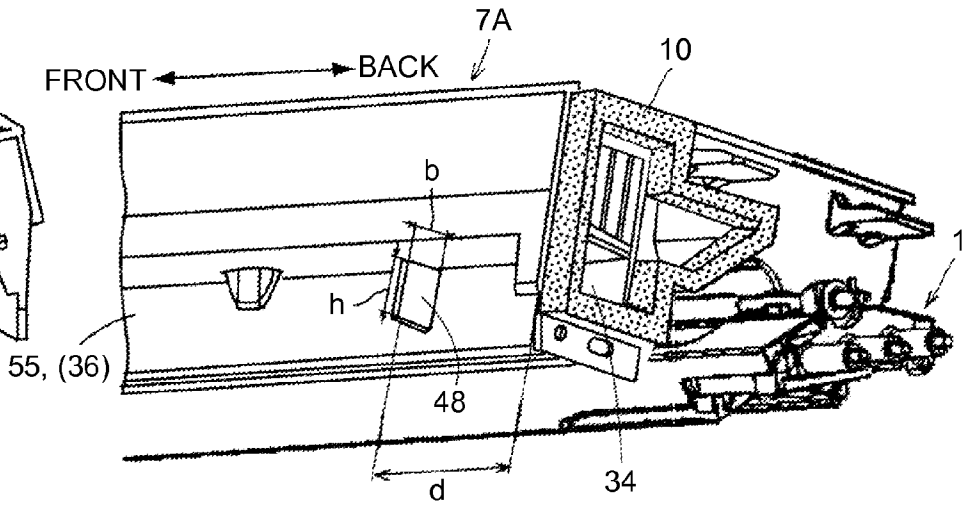
FIG. 23B is a perspective view illustrating details of the arrangement location and shape dimension of the first guide plate.
Figure 23A:
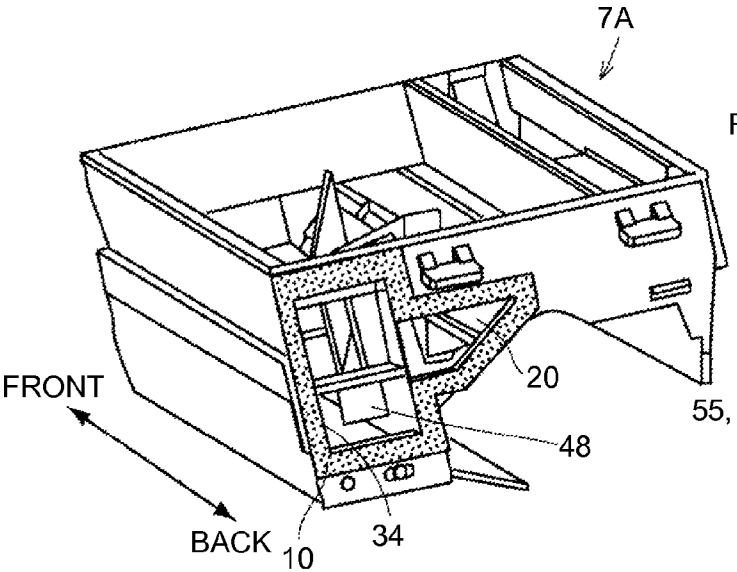
FIG. 23A is a perspective view of main parts illustrating the arrangement location of a first guide plate of the second embodiment.
Figure 24B:
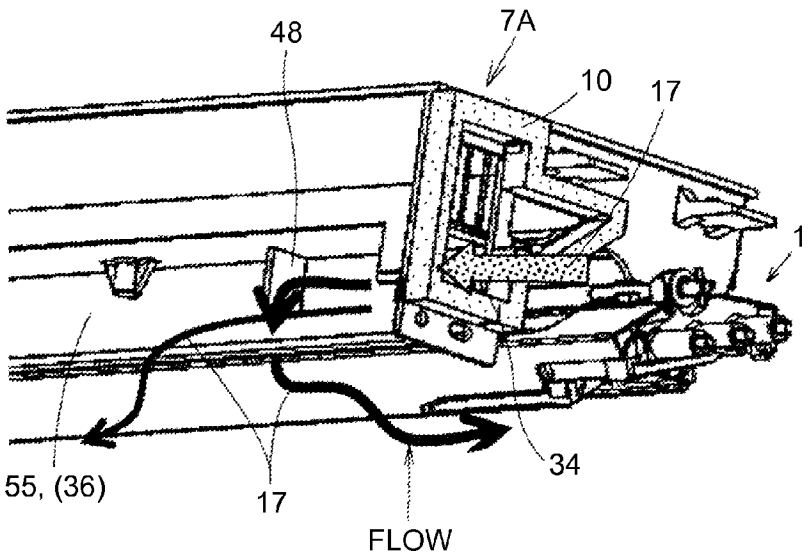
FIG. 24B is a perspective view illustrating how an airflow flows in the charging duct with the first guide plate.
Figure 24A:
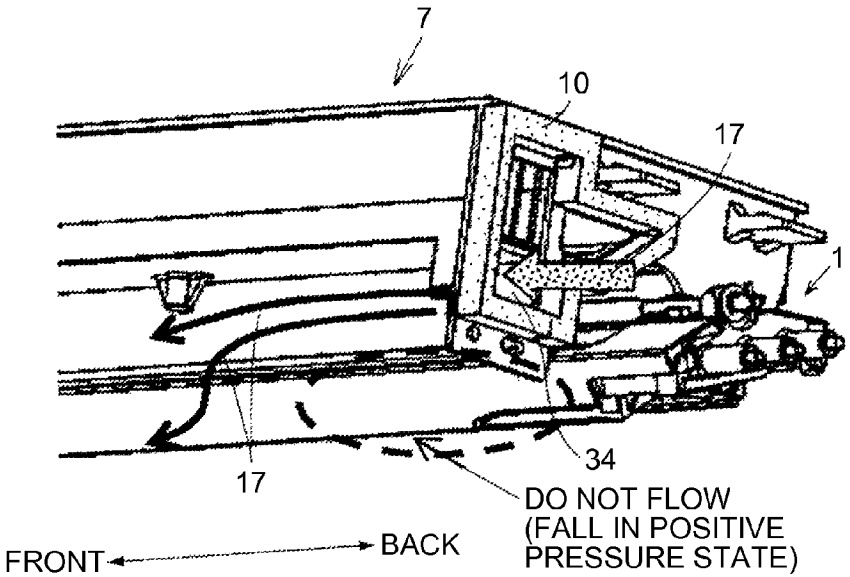
FIG. 24A is a perspective view illustrating how an airflow flows in the charging duct without the first guide plate.

Firstly, the details of the first arrangement location, shape dimension, and the like of the first guide plate 48 and how an airflow flows will be described with reference to FIGS. 23A, 23B, 24A, and 24B. FIG. 23A is a perspective view of main parts illustrating the arrangement location of the first guide plate 48, and FIG. 23B is a perspective view illustrating the details of the arrangement location and shape dimension of the first guide plate 48. FIGS. 24A and 24B are perspective views of main parts of the charging ducts 7 and 7A, illustrating, with the examination results, how the airflow 17 flows when there is not the first guide plate 48 and how the airflow 17 flows when there is the first guide plate 48, respectively.

The first guide plate 48 is arranged in the vicinity of the entry of the lower intake port 34 with a predetermined shape as illustrated in FIGS. 23A and 23B. Specifically, the first guide plate 48 has a rectangular thin plate shape, and is integrally formed of resin and arranged at a position recessed by a distance d=60 mm into the downstream side (the front side in the longitudinal direction of the charging duct 7A) of the lower airflow path 36 from the entry position of the lower intake port 34. The dimension/size of the first guide plate 48 is a rectangular shape with a width b of 11 mm and a height h of 15 mm. As the result of the examinations, it is found that the distance d to the above arrangement position of the first guide plate 48, be longer or shorter than 60 mm, influences the balance of flow velocity. Therefore, the distance d is set to 60 mm as an optimal position.

As illustrated in FIG. 24A, in the case of the charging duct 7 without the first guide plate 48, it has been confirmed that with regard to the flow of the airflow 17, the vicinity of the entry of the intake port 34, encircled and illustrated by the broken line, had a substantially positive pressure and accordingly the airflow 17 did not flow. On the other hand, as illustrated in FIG. 24B, in the case of the charging duct 7A with the first guide plate 48, a negative pressure state was maintained in the vicinity of the entry of the intake port 34, and the normal flow of the airflow 17 has been confirmed. In this manner, with the arrangement of the first guide plate 48 with the above specific shape/dimension at the predetermined position, the airflow 17 entering from the lower intake port 34 abuts against the first guide plate 48, and the flow is changed. Accordingly, an airflow is flown to the location that is difficult to flow in FIG. 22 and therefore it is possible to ensure the uniform distribution of the airflow 17 across the longitudinal direction of the charging duct 7. FIG. 24B illustrates a state where the intake duct 57 of FIG. 18 is removed.

Figure 25:
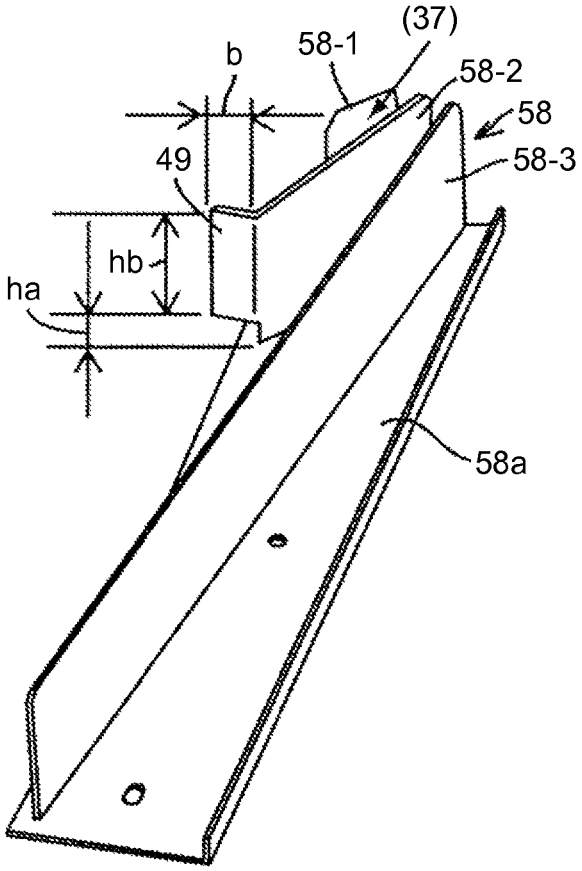
FIG. 25 is a perspective view illustrating the details of the arrangement location and shape dimension of a second guide plate of the second embodiment.
Figure 26:
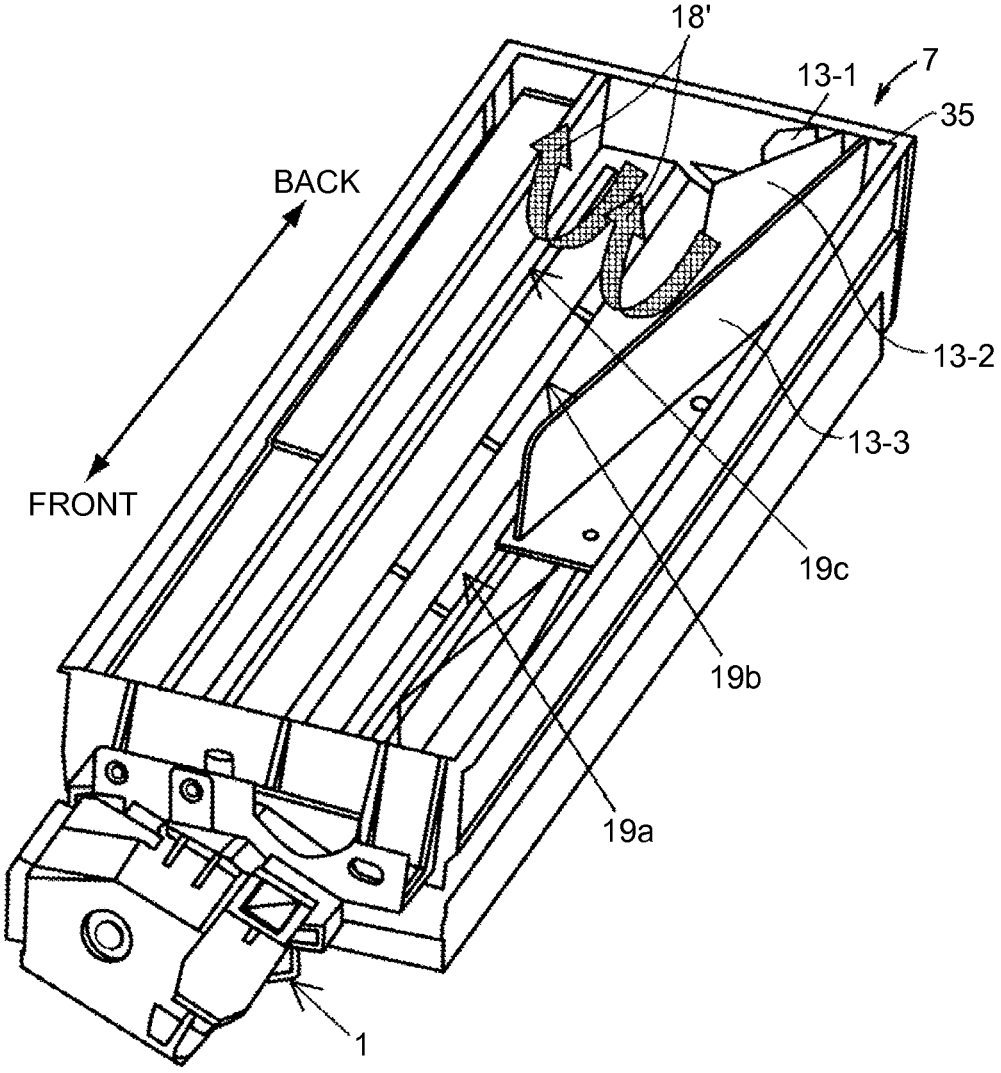
FIG. 26 is a perspective view of main parts of the charging duct, illustrating how an airflow flows when there is not the second guide plate.
Figure 27:
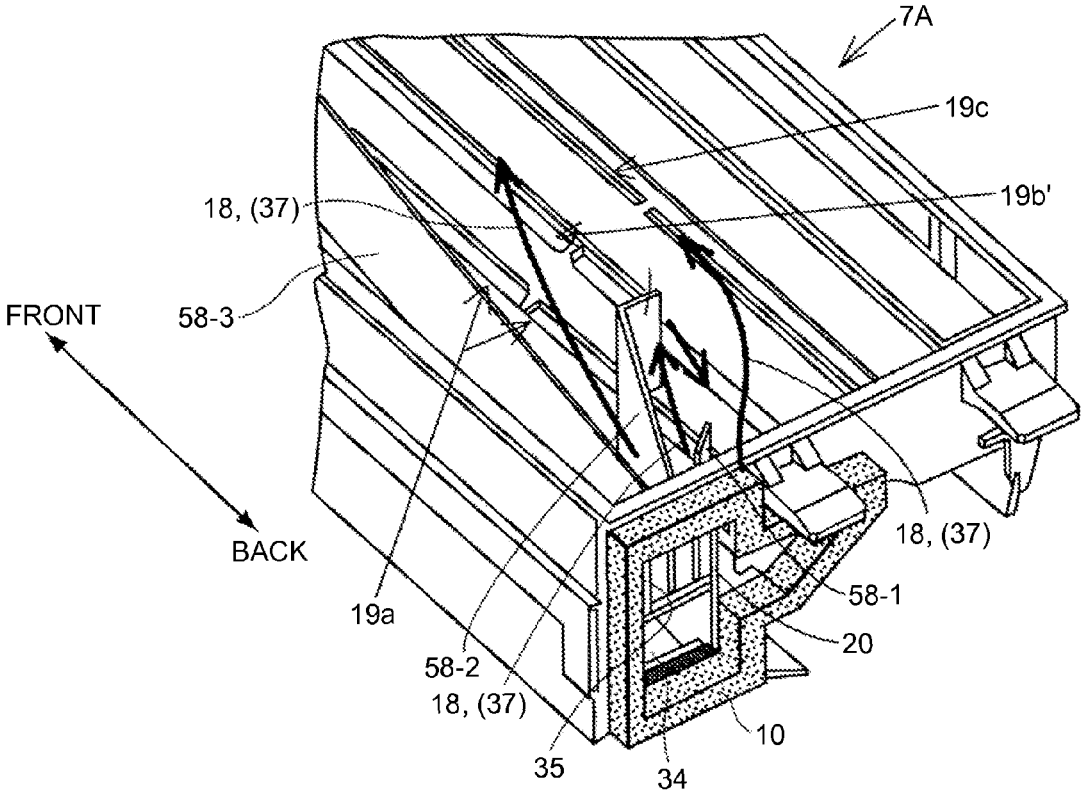
FIG. 27 is a perspective view of main parts of the charging duct, illustrating how an airflow flows when there is the second guide plate.
Figure 28B:
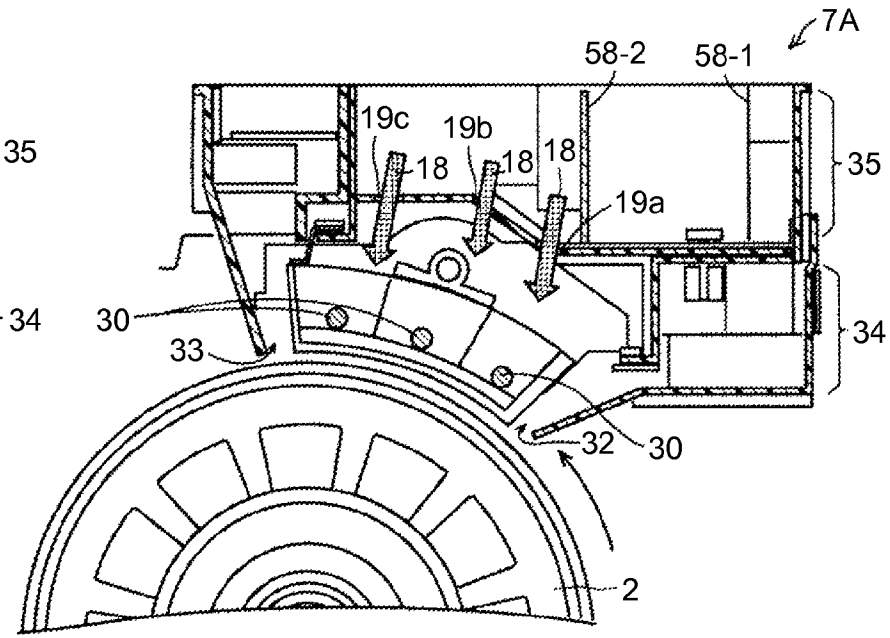
FIG. 28B is a cross-sectional view around the charging duct, illustrating how an airflow flows when there is the second guide plate.
Figure 28A:
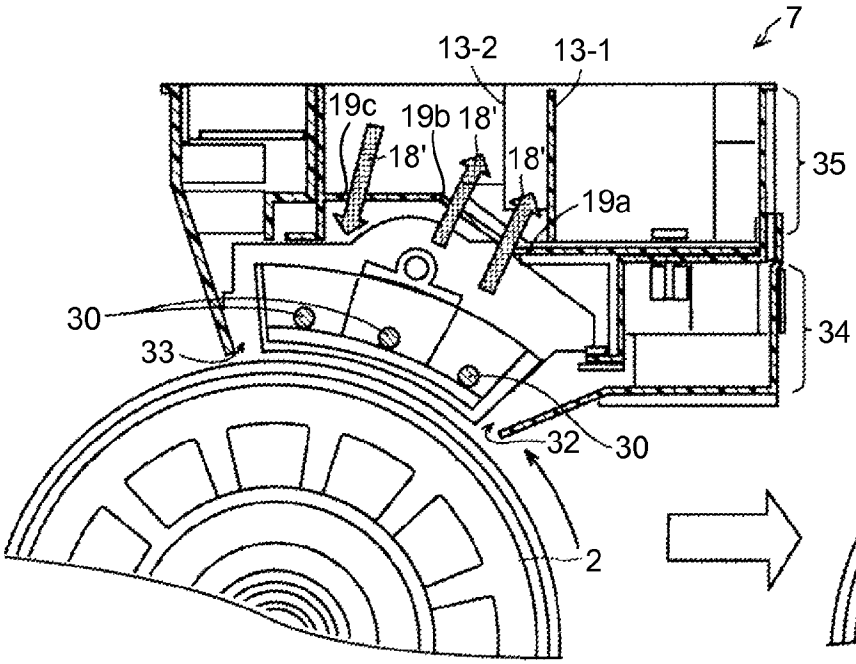
FIG. 28A is a cross-sectional view around the charging duct, illustrating how an airflow flows when there is not the second guide plate.

Next, the details of the second arrangement location, shape dimension, and the like of the second guide plate 49 and how an airflow flows will be described with reference to FIGS. 25 to 28B. FIG. 25 is a perspective view illustrating the details of the arrangement location and shape dimension of the second guide plate 49. FIG. 26 is a perspective view of main parts of the charging duct 7 illustrating how the airflow 18 flows when there is not the second guide plate 49. FIG. 27 is a perspective view of main parts of the charging duct 7A illustrating how the airflow 18 flows when there is the second guide plate 49. FIG. 28A is a cross-sectional view around the charging duct 7 illustrating how the airflow 18 flows when there is not the second guide plate 49, and FIG. 28B is a cross-sectional view around the charging duct 7A illustrating how the airflow 18 flows when there is the second guide plate 49.

As illustrated in FIGS. 26 and 28A, in order to check how the airflow 18 flows in the charging duct 7 without the second guide plate 49, an examination was conducted in which the airflow 18 was caused to flow to the three discharge wires 30 in the electric charger 1 through the three slit holes 19*a*, 19*b*, and 19*c* in the charging duct 7. At this point, a phenomenon was confirmed in which backflow occurred from the vicinity of the upper intake port 35 of the charging duct 7. There was a tendency that especially the amounts of backflow (indicated by an airflow 18') from the slit hole 19*a* (on the right side in the figure) and the slit hole 19*b* (at the center in the figure) were large. The cause is considered that it was difficult for the airflow 18 to flow in the vicinity of the upper intake port 35 in FIGS. 22 and 26 and accordingly the airflow 18 exited from the slit holes 19*a* and 19*b* since the vicinity of the upper intake port 35 became a positive pressure state. In other words, the charging duct 7A, including the charging duct 7 of the first embodiment, has a tendency that backflow tends to easily occur in the back side of the charging duct 7A as illustrated in FIG. 26 in terms of the configuration where the upper intake port 35 of the upper airflow path 37 is provided to the back side being the one end side in the longitudinal direction of the charging duct 7A. In short, there is a tendency that it is difficult to ensure the uniform distribution of the airflow 18 across the longitudinal direction of the charging duct 7.

As the above measure against backflow, the second guide plate 49 is arranged with a predetermined shape at a predetermined position in the embodiment. In other words, as illustrated in FIG. 25, the second guide plate 49 is arranged to be located at a leading end of the second partition plate 58-2 of the partition plate 58 in the charging duct 7A illustrated in FIG. 18. As illustrated in FIG. 27, the effect of abutting the airflow 18 flown from the upper intake port 35 against the second guide plate 49 and pushing the airflow back to the slit hole 19*b* (at the center in the figure) and the slit hole 19*c* (on the right side in the figure) is aimed by arranging the second guide plate 49 at such a specific position. The second guide plate 49 needs to be placed, paired with the first guide plate 48, in the charging duct 7A.

The first and third partition plates 58-1 and 58-3 are not provided with the second guide plate since there is no backflow. As illustrated in FIG. 25, the shape and size of the second guide plate 49 are set to a rectangular shape with the width b of 9 mm, a height ha at a position floating 6 mm from the surface of a base plate 58*a* of the partition plate 58 (having a space of 6 mm from the surface of the base plate 58*a*), and a height hb of 26.4 mm. If the width b of the second guide plate 49 is 9 mm or more, the backflow amount from the slit hole 19*c* is increased, and the balance of flow velocity in the longitudinal direction of the charging duct 7A is also worsened. With regard to an aim to place a base of the second guide plate 49 at the position floating 6 mm from the surface of the base plate 58*a*, the balance of flow velocity in the longitudinal direction of the charging duct 7A is considered. If there is no space described above, the balance of flow velocity to the front side in the longitudinal direction of the charging duct 7A is worsened.

Figure 29B:
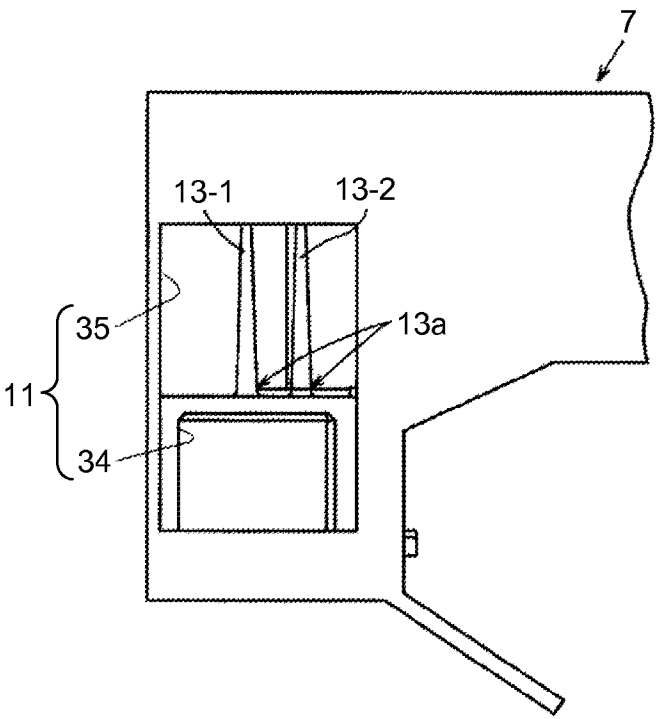
FIG. 29B is a rear view when viewing, from the back side, the charging duct illustrating the sizes of the bases of the first to third partition plates.
Figure 29A:
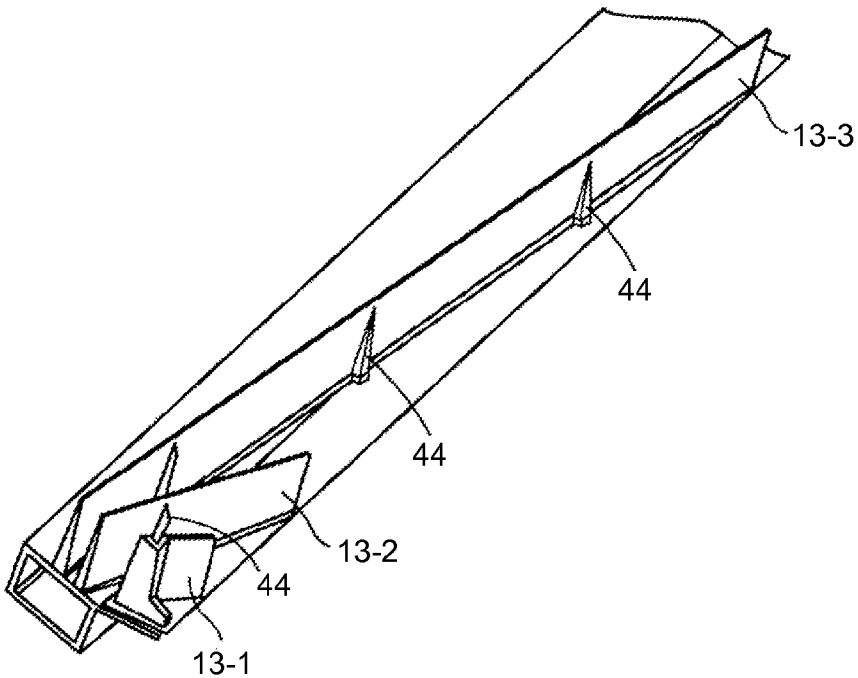
FIG. 29A is a perspective view of a reinforcing rib illustrating a problem, which needs to be improved, of first to third partition plates of the first embodiment.

Moreover, the first to third partition plates 58-1, 58-2, 58-3 themselves are made as separate parts similarly to the first to third partition plates 13-1, 13-2, and 13-3 of the charging duct 7. As illustrated in FIGS. 29A and 29B, the first to third partition plates 13-1, 13-2, and 13-3 of the charging duct 7 are manufactured of resin, but their heights are increased to 34.4 mm that is higher than the width of the upper intake port 35 in the up and down direction in terms of securing the functions of the first to third partition plates 13-1, 13-2, and 13-3. Therefore, as illustrated in FIG. 29B, bases 13*a* of the partition plates 13-1, 13-2, and 13-3 are thickened for processing, and as illustrated in FIG. 29A, a reinforcing rib 44 is required to provide stiffness. Consequently, it is difficult for airflow to flow, and it is disadvantageous to the balance of flow velocity.

In order to improve such points, the first to third partition plates 58-1, 58-2, and 58-3 and the second guide plate 49 of the charging duct 7A of the embodiment are formed of sheet metal being a metal thin sheet. In the embodiment, the first to third partition plates 58-1, 58-2, and 58-3 are made of sheet metal and accordingly these problems are improved. The second guide plate 49 is integrally formed at the leading end of the second partition plate 58-2 by sheet metal bending.

An examination to check how the airflow 18 flows was conducted using the charging duct 7A (including the second guide plate 49, and the first to third partition plates 58-1, 58-2, and 58-3) of the embodiment. As a result of the examination, as illustrated in FIG. 28B, the effect has been confirmed in which the airflow 18 flows normally, without backflow, through the three slit holes 19*a*, 19*b*, and 19*c* in the charging duct 7 to the three discharge wires 30 in the electric charger 1.

According to the embodiment, to say nothing of taking the effect of the first embodiment, the placement of the first guide plate 48 in the vicinity of the entry of the lower intake port 34 in the back side of the charging duct 7A enables improvement in the flow of an airflow in the positive pressure state and prevention of backflow, and especially improvement in the balance of flow velocity in the back side in the longitudinal direction of the charging duct 7A. Moreover, the placement position and the shape of the first guide plate 48 is optimized to the predetermined position and shape as described above. Accordingly, it becomes possible to force the airflow 17 to flow to the vicinity of the lower intake port 34, the vicinity being in the positive pressure state, and it is possible to improve the balance of flow velocity in the longitudinal direction of the charging duct 7A.

Moreover, the inclusion of the charging duct 7A having the first to third sheet-metal partition plates 58-1, 58-2, and 58-3 leads to the thinning of the partition plates as partition members and increase in the degree of freedom in their arrangement in the upper intake port 35. Moreover, a reinforcing rib necessary for a partition plate made of resin is gone, and it is possible to significantly improve the flow of an airflow. Moreover, it is also possible to simultaneously solve restriction of the height, processability, and strength of the partition plate (if the partition plate is made of resin, its leading end becomes thin and accordingly may become chipped upon assembly). Furthermore, the sheet-metal second guide plate 49 is added to the leading end of the second partition plate 58-2 (the leading end on the downstream side of the airflow 18) and accordingly, backflow from the slit holes (especially the slit holes 19*a* and 19*b*) can be reduced. It is found that the above effect cannot be obtained if the second guide plate 49 is used without being paired with the first guide plate 48.

In the first and second embodiments, it is configured that the intake fan 5 as an intake unit communicates with the charging duct 7 via the intake fan duct 6, and the exhaust fan 9 as an exhaust unit communicates with the charging duct 7 as a charging duct member via the exhaust fan duct 8. However, the present invention is not limited to this. In other words, it may be configured that the intake fan duct 6 and the exhaust fan duct 8 are removed, and the intake unit and the exhaust unit are attached directly to the charging duct member to communicate airflow.

The first and second embodiments are not limited to this, but it may be configured that the charging duct member forms only an airflow wall forming unit.

Moreover, in the first and second embodiments, the kinds of the intake fan 5 and the exhaust fan 9 are not specified, but an axial fan being an axial fan, a multiple blade fan (sirocco fan) being a centrifugal fan, and the like may be used in accordance with their purposes and functions. Furthermore, the intake unit and the exhaust unit are not limited to the first and second embodiments where they are respectively arranged as a single unit, but it may be an example where a combination of a single unit and a plurality of units or a plurality of both units is used.

The descriptions have been given in the first and second embodiments, respectively, taking the example of the configuration where the charging device 100 includes the charging duct 7 and the electric charger 1 and the example of the configuration where the charging device 100A includes the charging duct 7A and the electric charger 1. However, the present invention is not limited to them. In other words, a charging device including a discharge electrode and an opening for charging, and a charging duct member are separated, and the charging duct member, the intake unit, and the exhaust unit as well as an image carrier are attached to an image forming apparatus body side. The charging device separated from the charging duct member configures a charging unit detachable from the image forming apparatus body. This may be a configuration example.

The airflow wall forming unit in the first and second embodiments is not limited to this, but may be configured to form only an airflow wall in extreme cases, and to have a configuration where the charging duct member is not necessary. The technical idea of the present invention includes such a configuration example. In other words, for example, for the formation of an airflow wall, cited is an example of including an air-blowing unit having a fan duct that causes airflow to flow so as to cover the entire opening portion 31 (technically the opposed opening portion) from the upstream end in the rotation direction of the photosensitive drum 2 at the opening portion 31 of the charger body 1A to the downstream end in the rotation direction of the photosensitive drum 2 at the opening portion 31, and an exhaust unit having an exhaust duct for exhausting the airflow of the airflow wall. In the first and second embodiments of the present invention, as a measure against reduction in the life of the discharge wire due to foreign object contamination, the charging duct member is required to simultaneously satisfy the configuration of having the airflow effect of removing ozone products similarly to before in addition to the configuration having the airflow effect where airflow is made good use of and foreign objects are not attracted and attached to the discharge wire.

The embodiments described above are examples of the present invention, and the present invention takes a specific effect depending on the following aspects.

[Aspect A]

A charging device such as a charging device 100 or 100A including: a discharge electrode, such as the discharge wire 30, for charging the surface of an image carrier such as the photosensitive drum 2; a charging device body such as the charger body 1A having an opening portion for charging, such as the opening portion 31, that surrounds the discharge electrode and that is provided across the longitudinal direction of the discharge electrode while opposed to the surface of the image carrier; a charging duct member, such as the charging duct 7 or 7A, configured to surround at least the entire opening portion of the charging device body and to be capable of introducing and exhausting an airflow within the surrounded area; an intake unit, such as the intake fan 5, for generating an airflow to be guided into the charging duct member; and an exhaust unit, such as the exhaust fan 9, for exhausting the airflow guided into the charging duct member, in which the charging duct member has an airflow forming unit (the intake exit 32 and the exhaust entry 33) that covers, with an airflow wall, such as the airflow wall 29, of an airflow, the entire opening portion from an upstream end in the rotation direction of the image carrier at the opening portion to a downstream end in the rotation direction of the image carrier at the opening portion.

According to aspect A, as described in the embodiments, the entire opening portion, such as the opening portion 31, of the charging device body from the upstream end in the rotation direction of the image carrier at the opening portion to the downstream end in the rotation direction of the image carrier at the opening portion is covered with the airflow wall (air barrier) of the intake airflow; accordingly, it is possible to prevent foreign objects from the outside (for example, toner particles and paper powder) from attaching to the discharge electrode, and to promote the extension of the life of the discharge electrode.

[Aspect B]

In the charging device of aspect A, the airflow wall forming unit includes an intake exit, such as the intake exit 32, formed between a charging device body such as the electric charger 1A and the charging duct member such as the charging duct 7 or 7A, which are on the upstream end portion side in the rotation direction of the image carrier such as the photosensitive drum 2 at the opening portion, and an exhaust entry, such as the exhaust entry 33, formed between the charging device body and the charging duct member, which are on the downstream end portion side in the rotation direction of the image carrier at the opening portion.

[Aspect C]

In the charging device of aspect A or aspect B, an intake port, such as the intake port 11, of the charging duct member, such as the charging duct 7 or 7A, that communicates with the intake unit such as the intake fan 5 is divided into two, and the intake ports communicate respectively with independent airflow paths formed independently in the charging duct member. One of the independent airflow paths, such as the lower airflow path 36, of the intake ports is formed closer to the surface side of the image carrier such as the photosensitive drum 2 to form the airflow wall such as the airflow wall 29. The other independent airflow path, such as the upper airflow path 37, of the intake ports is formed to merge an intake airflow with the airflow wall via the discharge electrode such as the discharge wire 30.

According to aspect C, as described in the above embodiments, the intake port of the charging duct member is divided into two to form the one of the independent airflow paths such as the lower airflow path 36 and accordingly it is possible to form the airflow wall (air barrier) such as the airflow wall 29. Moreover, one intake unit such as the intake fan 5 is sufficient for handling, it is possible to contribute to space saving in terms of the number of intake units (fans) used and placement of an intake duct member and the like.

[Aspect D]

In the charging device of aspect C, with regard to the magnitude of flow velocities of airflows flowing through the one of the independent airflow paths such as the lower airflow path 36 and the other independent airflow path such as the upper airflow path 37, the flow velocity of the one of the independent airflow paths is set greater than the flow velocity of the other independent airflow path.

According to aspect D, as described in the embodiments, it becomes possible to simultaneously realize an effect of extension of the life of the discharge electrode and an effect of removal of ozone generated from the discharge electrode, as roles of an airflow effect.

[Aspect E]

In the charging device of aspect D, the flow velocity of the one of the independent airflow paths such as the lower airflow path 36 is set to approximately 0.6 to 0.8 m/sec, and the flow velocity of the other independent airflow path such as the upper airflow path 37 to approximately 0.2 to 0.4 m/sec.

According to aspect E, as described in the embodiments, it is possible to adjust the flow velocities to optimal flow velocity values by dividing, into two, the intake port of the charging duct member such as the charging duct 7 or 7A, and it is possible to simultaneously realize the effect of extension of the life of the discharge electrode and the effect of removal of ozone generated from the discharge electrode as the roles of the airflow effect.

[Aspect F]

In the charging device of aspect C, the passage sectional area of the one of the independent airflow paths such as the lower airflow path 36 is smaller than that of the other independent airflow path such as the upper airflow path 37.

According to aspect F, as described in the embodiments, this is a precondition of similar effects to those of aspect D and aspect E.

[Aspect G]

In the charging device according to any one of aspect C to aspect F, the one of the independent airflow paths such as the lower airflow path 36 is formed using an outer wall surface of the charging device body such as the electric charger 1A, and an inner wall surface, such as the inner wall surface 40, of the charging duct member such as the charging duct 7 or 7A.

According to aspect G, as described in the embodiments, the one of the independent airflow paths such as the lower airflow path 36 is formed and accordingly it is possible to contribute to reduction in the number of parts and space saving.

[Aspect H]

In the charging device according to any one of aspect A to aspect G, the opening area of an exhaust port such as the exhaust port 12 of the charging duct member, such as the charging duct 7 or 7A, that communicates with the exhaust unit such as the exhaust fan 9 is smaller than that of the intake port, such as the intake port 11, of the charging duct member that communicates with the intake unit such as the intake fan 5.

According to aspect H, as described in the embodiments, it is possible to increase a foreign object collection force and a suction force to draw foreign objects, for example, to the exhaust fan duct 8.

[Aspect I]

In the charging device according to any one of aspect A to aspect G, an intake hole for backflow prevention such as the intake hole 20 is provided in the vicinity of the intake port, such as the intake port 11, of the charging duct member.

According to aspect I, as described in the embodiments, with the addition of the intake hole, it is possible to take a measure against backflow in the charging duct member. Moreover, also with regard to the shape of the duct member at that point, the shape of a sponge duct being an elastic body is changed and accordingly the duct can be easily made.

[Aspect J]

In the charging device of aspect I, the intake port such as the intake port 11 and the intake hole such as the intake hole 20 are connected to the duct member to be connected via the elastic foam body.

According to aspect J, as described in the embodiments, with the addition of the intake hole such as the intake hole 20, the connection shape with the duct member cannot be a simple shape such as a conventional square and generally becomes complicated. However, the connection is made via the elastic foam body. Therefore, it is possible to handle even a complicated shape of the duct member, and easily make the connection shape with the duct member.

[Aspect K]

In the charging device according to any one of aspect C to aspect J, the intake port such as the lower intake port 34 on the one of the independent airflow paths side such as the lower airflow path 36 is provided to one end side in the longitudinal direction of the charging duct member such as the charging duct 7A. The other independent airflow path is provided with a first guide member, such as the first guide plate 48, for improvement in the balance of flow velocity.

According to aspect K, as described in the embodiments, it is possible to improve the flow of the airflow in a positive pressure portion, and to improve the balance of flow velocity on the one end side (for example, the back side described above) in the longitudinal direction of the charging duct member.

[Aspect L]

In the charging device of aspect K, the first guide member such as the first guide plate 48 is arranged with a predetermined shape at a predetermined position in the vicinity of an entry of the intake port, such as the lower intake port 34, of the one of the independent airflow paths such as the lower airflow path 36.

According to aspect L, as described in the embodiments, the shape and placement position of the first guide member are optimized. Accordingly, it becomes possible to force the airflow to flow to the vicinity of the first intake port having a positive pressure, and it is possible to improve the balance of flow velocity on the one end side (for example, the back side described above) in the longitudinal direction of the charging duct member.

[Aspect M]

In the charging device according to any one of aspect C to aspect L, the intake port, such as the upper intake port 35, on the other independent airflow path side such as the upper airflow path 37 is provided to the one end side in the longitudinal direction of the charging duct member such as the charging duct 7A. The other independent airflow path is provided with a plurality of partition members such as the three partition plates 58-1, 58-2, and 58-3 across the longitudinal direction of the charging duct member. At least one of the plurality of partition members such as the second partition plate 58-2 is provided with a second guide member, such as the second guide plate 49, for improvement in the balance of flow velocity and backflow prevention.

According to aspect M, as described in the embodiments, backflow from, for example, the slit holes 19*a*, 19*b*, and 19*c* can be reduced.

[Aspect N]

In the charging device of aspect M, the plurality of partition members such as the three partition plates 58-1, 58-2, and 58-3 and the second guide member of the second guide plate 49 are formed of a thin metal sheet.

According to aspect N, as described in the embodiments, the degree of freedom in arrangement in the intake port portion increases. Moreover, it is possible to eliminate the necessity of a reinforcing rib which is required in a case of a partition plate made of resin, and to significantly improve the flow of the airflow. Moreover, if the partition plate is made of resin, it becomes thin at a leading end portion and therefore it may become chipped upon assembly. However, it is also possible to prevent such damage in advance and solve restriction of the height, processability, and strength of the partition member.

[Aspect O]

In the charging device of aspect M or aspect N, the number of the plurality of partition members such as the three partition plates 58-1, 58-2, and 58-3 is three, and the second guide member such as the second guide plate 49 is provided with a predetermined shape at a leading end portion of one of the three partition members.

According to aspect O, as described in the embodiments, the shape and placement position of the second guide member is optimized, which ensures the effects of the above aspect M and aspect N.

[Aspect P]

In the charging device according to any one of aspect A to aspect O, the charging device body such as the electric charger 1A is provided detachably from the charging duct member such as the charging duct 7 or 7A.

According to aspect P, it is possible to improve operability such as replacement, cleaning, and maintenance of the charging device body.

[Aspect Q]

A charging device including: a discharge electrode, such as the discharge wire 30, for charging the surface of an image carrier such as the photosensitive drum 2; a charging device body, such as the charger body 1A, having an opening portion for charging, such as the opening portion 31, that surrounds the discharge electrode and that is provided across the longitudinal direction of the discharge electrode while opposed to the surface of the image carrier; and a charging duct member, such as the charging duct 7 or 7A, configured to surround the entire opening portion excluding an opposed opening portion opposed to the surface of the image carrier at the opening portion and to be capable of introducing and exhausting an airflow within the surrounded area, in which the charging duct member configures an airflow forming unit (the intake exit 32 and the exhaust entry 33) that covers, with an airflow wall, such as the airflow wall 29, of an airflow, the entire opposed opening portion from an upstream end in the rotation direction of the image carrier at the opening portion to a downstream end in the rotation direction of the image carrier at the opening portion.

According to aspect Q, as described in the embodiments, the entire opening portion, such as the opening portion 31, of the charging device body from the upstream end in the rotation direction of the image carrier at the opening portion to the downstream end in the rotation direction of the image carrier at the opening portion is covered with the airflow wall (air barrier) of the intake airflow; accordingly, it becomes possible to attach foreign objects from the outside (for example, toner particles and paper powder) to the discharge electrode, and to promote the extension of the life of the discharge electrode.

[Aspect R]

An image forming apparatus including the charging device according to any one of aspect A to aspect Q.

According to aspect R, as described in the embodiments, it is possible to realize and provide the image forming apparatus that takes the above effect according to any of aspect A to aspect Q.

[Aspect S]

In the image forming apparatus of aspect R, the charging device configures a charging unit detachable from an image forming apparatus body such as the image forming apparatus body 50.

According to aspect S, as described in the embodiments, it is possible to improve operability such as replacement, cleaning, and maintenance of the charging unit.

[Aspect T]

A charging unit detachable from an image forming apparatus body such as the image forming apparatus body 50, including: a discharge electrode, such as the discharge wire 30, for charging the surface of an image carrier such as the photosensitive drum 2; a charging device, such as the charging device 100 or 100A, having an opening portion for charging, such as the opening portion 31, that surrounds the discharge electrode and that is provided across the longitudinal direction of the discharge electrode while opposed to the surface of the image carrier; and a charging duct member, such as the charging duct 7 or 7A, configured to surround the entire opening portion excluding an opposed opening portion opposed to the surface of the image carrier at the opening portion and to be capable of introducing and exhausting an airflow within the surrounded area, in which the image carrier, an intake unit, such as the intake fan 5, for generating an airflow to be guided into the charging duct member, an intake unit, such as the intake fan 5, for generating an airflow guided into the charging duct member, and an exhaust unit, such as the exhaust fan 9, for exhausting the airflow guided into the charging duct member are included on an image forming apparatus body side, and the charging duct member of the charging unit is provided so as to configure an airflow wall forming unit (the intake exit 32 and the exhaust entry 33) that covers, with an airflow wall, such as the airflow wall 29, of an airflow, the entire opposed opening portion from an upstream end in the rotation direction of the image carrier at the opening portion of the charging device to a downstream end in the rotation direction of the image carrier at the opening portion.

According to aspect T, as described in the embodiments, it is possible to prevent foreign objects from the outside (for example, toner particles and paper powder) from attaching to the discharge electrode, and to improve operability such as replacement, cleaning, and maintenance of the charging unit capable of promoting the extension of the life of the discharge electrode.

The specific embodiments and the like of the present invention have been described. However, the technical content disclosed by the present invention is not limited to those illustrated in the above-mentioned embodiments and the like, but may be configured by combining them as appropriate. It is clear to those skilled in the art that various embodiments, modifications, or examples can be configured in accordance with a necessity, application, and the like thereof within the scope of the present invention.

In the above embodiments, the descriptions have been given taking the example of a scorotron charging device including a grid electrode as a discharge current control member, and the like in addition to what is called a discharge electrode. However, the present invention is not limited to this, but can also be applied to a corotron charging device including a discharge electrode, and the like.

Moreover, the embodiments can be applied to or made practical use of by a neutralization device.

According to the embodiments, with the above configurations, the entire opening portion of the discharge device body from the upstream end in the rotation direction of the image carrier at the opening portion to the downstream end in the rotation direction of the image carrier at the opening portion is covered with the airflow wall (air barrier) of the airflow. Accordingly, it possible to prevent foreign objects (for example, tonner particles and paper powder) from the outside from attaching to the discharge electrode, and to promote the extension of the life of the discharge electrode.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A charging device comprising:

a discharge electrode configured to charge a surface of an image carrier;

a charging device body including an opening portion for charging, the opening portion being provided so as to surround the discharge electrode and be opposed to a surface of the image carrier across a longitudinal direction of the discharge electrode;

a charging duct member provided so as to surround at least the entire opening portion of the charging device body, the charging duct member being configured to introduce and exhaust an airflow within the surrounded area, the charging duct member including, an intake port configured to communicate with the intake unit and divided into a first intake port and a second intake port, the first intake port being configured to communicate with a first independent airflow path formed independently in the charging duct member, the second intake port being configured to communicate with a second independent airflow path formed independently in the charging duct member, the first independent air flow path being formed relatively closer to the surface side of the image carrier to form an airflow wall, the second independent airflow path being formed to merge the airflow with the airflow wall via the discharge electrode, the first independent airflow path having a velocity of approximately 0.6 to 0.8 m/sec, the second independent airflow path being formed to merge an airflow with the airflow wall via the discharge electrode, the second independent airflow path having a velocity of approximately 0.2 to 0.4 m/sec;

an intake unit configured to generate an airflow to be guided into the charging duct member; and an exhaust unit configured to exhaust the airflow guided into the charging duct member, the charging duct member including an airflow wall forming unit configured to cover, with the airflow wall, the entire opening portion from an upstream end in a rotation direction of the image carrier at the opening portion to a downstream end in the rotation direction of the image carrier at the opening portion, the airflow wall forming unit including, an intake exit portion, provided between the charging device body and the charging duct member on an upstream side in the rotation direction of the image carrier at the opening portion, and an exhaust entry portion, provided between the charging device body and the charging duct member on a downstream side in the rotation direction of the image carrier at the opening portion, the airflow wall being formed by an airflow flowing from the intake exit portion to the exhaust entry portion.

2. The charging device according to claim 1, wherein a passage sectional area of the first independent airflow path is set relatively smaller than that of the second independent airflow path.

3. The charging device according to claim 1, wherein the first independent airflow path is formed using an outer wall surface of the charging device body and an inner wall surface of the charging duct member.

4. The charging device according to claim 1, wherein an opening area of an exhaust port of the charging duct member, configured to communicate with the exhaust unit, is relatively smaller than that of an intake port of the charging duct member configured to communicate with the intake unit.

5. The charging device according to claim 4, wherein the intake port is divided into a first intake port and a second intake port, the first intake port is configured to communicate with a first independent airflow path formed independently in the charging duct member, the second intake port is configured to communicate with a second independent airflow path formed independently in the charging duct member, the first independent air flow path is formed relatively closer to the surface side of the image carrier to form the airflow wall, and the second independent airflow path is formed to merge an airflow with the airflow wall via the discharge electrode, the first intake port is provided on one end side in the longitudinal direction of the charging duct member, and the first independent airflow path is provided with a first guide member for improvement in balance of flow velocity.

6. The charging device according to claim 5, wherein the first guide member is arranged with a defined shape at a position in the vicinity of an entry of the first intake port.

7. The charging device according to claim 4, wherein the intake port is divided into a first intake port and a second intake port, the first intake port is configured to communicate with a first independent airflow path formed independently in the charging duct member, the second intake port is configured to communicate with a second independent airflow path formed independently in the charging duct member, the first independent air flow path is formed relatively closer to the surface side of the image carrier to form the airflow wall, and the second independent airflow path is formed to merge an airflow with the airflow wall via the discharge electrode, the second intake port is provided to one end side in the longitudinal direction of the charging duct member, the second independent airflow path is provided with a plurality of partition members across the longitudinal direction of the charging duct member, and at least one of the plurality of partition members is provided with a second guide member for improvement in the balance of flow velocity and backflow prevention.

8. The charging device according to claim 1, wherein the first intake port is provided on one end side in the longitudinal direction of the charging duct member, and the first independent airflow path is provided with a first guide member for improvement in balance of flow velocity.

9. The charging device according to claim 8, wherein the first guide member is arranged with a defined shape at a position in the vicinity of an entry of the first intake port.

10. The charging device according to claim 1, wherein the second intake port is provided to one end side in the longitudinal direction of the charging duct member, the second independent airflow path is provided with a plurality of partition members across the longitudinal direction of the charging duct member, and at least one of the plurality of partition members is provided with a second guide member for improvement in the balance of flow velocity and backflow prevention.

11. The charging device according to claim 10, wherein the number of the plurality of partition members provided is three, and the second guide member is provided with a predetermined shape at a leading end portion of one of the three partition members.

12. A charging device, comprising:

a discharge electrode configured to charge a surface of an image carrier;

a charging device body, including an opening portion for charging, the opening portion being provided so as to surround the discharge electrode and be opposed to a surface of the image carrier across a longitudinal direction of the discharge electrode;

a charging duct member provided so as to surround at least the entire opening portion of the charging device body, the charging duct member being configured to introduce and exhaust an airflow within the surrounded area;

an intake unit configured to generate an airflow to be guided into the charging duct member; and an exhaust unit configured to exhaust the airflow guided into the charging duct member, the charging duct member including an airflow wall forming unit configured to cover, with an airflow wall, the entire opening portion from an upstream end in a rotation direction of the image carrier at the opening portion to a downstream end in the rotation direction of the image carrier at the opening portion, wherein an intake hole for backflow prevention is provided in the vicinity of an intake port of the charging duct member communicating with the intake unit.

13. The charging device according to claim 12, wherein the intake port and the intake hole are connected to the duct member to be connected via an elastic foam body.

14. The charging device according to claim 12, wherein the intake port is divided into a first intake port and a second intake port, the first intake port is configured to communicate with a first independent airflow path formed independently in the charging duct member, the second intake port is configured to communicate with a second independent airflow path formed independently in the charging duct member, the first independent air flow path is formed relatively closer to the surface side of the image carrier to form the airflow, wall, and the second independent airflow path is formed to merge an airflow with the airflow wall via the discharge electrode, the first intake port is provided on one end side in the longitudinal direction of the charging duct member, and the first independent airflow path is provided with a first guide member for improvement in balance of flow velocity.

15. The charging device according to claim 14, wherein the first guide member is arranged with a defined shape at a position in the vicinity of an entry of the first intake port.

16. The charging device according to claim 12, wherein the intake port is divided into a first intake port and a second intake port, the first intake port is configured to communicate with a first independent airflow path formed independently in the charging duct member, the second intake port is configured to communicate with a second independent airflow path formed independently in the charging duct member, the first independent air flow path is formed relatively closer to the surface side of the image carrier to form the airflow wall, and the second independent airflow path is formed to merge an airflow with the airflow wall via the discharge electrode, the second intake port is provided to one end side in the longitudinal direction of the charging duct member, the second independent airflow path is provided with a plurality of partition members across the longitudinal direction of the charging duct member, and at least one of the plurality of partition members is provided with a second guide member for improvement in the balance of flow velocity and backflow prevention.

* * * * *